US010920999B2

(12) United States Patent
Yanase et al.

(10) Patent No.: US 10,920,999 B2
(45) Date of Patent: Feb. 16, 2021

(54) OUTDOOR UNIT FOR AIR-CONDITIONING APPARATUS

(71) Applicant: Mitsubishi Electric Corporation, Tokyo (JP)

(72) Inventors: Tomoya Yanase, Tokyo (JP); Kazuho Ito, Tokyo (JP); Kentaro Yonehara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/323,584

(22) PCT Filed: Nov. 11, 2016

(86) PCT No.: PCT/JP2016/083463

§ 371 (c)(1),
(2) Date: Feb. 6, 2019

(87) PCT Pub. No.: WO2018/087873

PCT Pub. Date: May 17, 2018

(65) Prior Publication Data

US 2019/0264929 A1 Aug. 29, 2019

(51) Int. Cl.
*F24F 1/22* (2011.01)
*F24F 1/38* (2011.01)

(52) U.S. Cl.
CPC . *F24F 1/22* (2013.01); *F24F 1/38* (2013.01)

(58) Field of Classification Search
CPC ..... F24F 1/20; F24F 1/22; F24F 1/38
See application file for complete search history.

(56) References Cited

U.S. PATENT DOCUMENTS

2015/0027670 A1* 1/2015 Jinnai ..... F24F 1/38 165/121
2015/0121933 A1 5/2015 Yamaguchi et al.
2016/0033146 A1* 2/2016 Jinnai ..... F24F 1/60 417/423.15

FOREIGN PATENT DOCUMENTS

CN 104633807 A 5/2015
CN 105444292 A * 3/2016
(Continued)

OTHER PUBLICATIONS

Keum, Outdoor Unit of Air Conditioner, May 7, 2010, KR20100046387A, Whole Document (Year: 2010).*
(Continued)

*Primary Examiner* — Larry L Furdge
(74) *Attorney, Agent, or Firm* — Posz Law Group, PLC

(57) ABSTRACT

A fan motor support includes a rightward-and-leftward direction guide piece which projects in a direction of approaching a fan motor from a lower intermediate transverse plate or an upper intermediate transverse plate extending across a pair of support columns in a rightward-and-leftward direction at a position above or below the fan motor in a vertical direction at a distance apart from the fan motor. The rightward-and leftward direction guide piece is formed to be opened in a direction opposite to a machine chamber in a rightward-and-leftward direction and recessed toward the machine chamber. A rightward-and-leftward direction guide groove which is configured to change a wiring path of the lead wire of the fan motor hooked thereto to a direction toward the machine chamber from the upward-and-downward direction.

8 Claims, 14 Drawing Sheets

(56) References Cited

FOREIGN PATENT DOCUMENTS

| | | | | |
|---|---|---|---|---|
| JP | S57-090082 | U | | 6/1982 |
| JP | S60-038570 | A | | 2/1985 |
| JP | H05-264061 | | | 10/1993 |
| JP | 2001-193969 | A | | 7/2001 |
| JP | 2003-207170 | A | | 7/2003 |
| KR | 20100046387 | A | * | 5/2010 |

OTHER PUBLICATIONS

Cheng et al., Motor Bracket and Air Conditioning Outdoor Unit, Mar. 30, 2016, CN105444292A, Whole Document (Year: 2016).*
International Search Report of the International Searching Authority dated Dec. 27, 2016 for the corresponding international application No. PCT/JP2016/083463 (and English translation).
Office Action dated May 27, 2020 issued in corresponding CN patent application No. 201680090338.8 (and English translation).

* cited by examiner

OUTDOOR UNIT FOR AIR-CONDITIONING APPARATUS

CROSS REFERENCE TO RELATED APPLICATION

This application is a U.S. national stage application of International Application No. PCT/JP2016/083463, filed on Nov. 11, 2016, the contents of which are incorporated herein by reference.

TECHNICAL FIELD

This invention relates to an outdoor unit for an air-conditioning apparatus, and more particularly, to a handling structure for a lead wire which is led out from a fan motor configured to drive an air-sending fan to rotate.

BACKGROUND

An inside of an outdoor unit for an air-conditioning apparatus is partitioned in a rightward-and-leftward direction into two spaces by a partition plate which stands upright on a bottom plate. One of the two spaces is a fan chamber in which a heat exchanger and an air-sending fan are arranged, and another of the two spaces is a machine chamber in which a compressor is installed. In an upper portion of the machine chamber, there is arranged an electrical component unit containing an electric board to which a plurality of electric/electronic components for controlling driving of the air-conditioning apparatus are mounted.

The air-sending fan is a propeller fan including a plurality of blades. The air-sending fan is positioned downstream of the heat exchanger along an air flow generated by the air-sending fan. A rotary shaft of a fan motor is connected to the air-sending fan, and the air-sending fan is rotated by a rotational drive force of the fan motor transmitted through the rotary shaft, thereby generating the air flow. The fan motor is positioned between the air-sending fan and the heat exchanger, and is mounted to a fan motor support having a lower portion fixed to the bottom plate. The fan motor support is positioned between the air-sending fan and the heat exchanger and also supports the air-sending fan through intermediation of the fan motor.

The fan motor includes a lead wire lead-out portion at a lower portion of the fan motor. A lead wire led out from the lead wire lead-out portion is connected to a connector on the electric board contained in the electrical component unit positioned above the fan motor. In order to avoid entanglement of a part of the lead wire, which is led from the fan motor to the connector, with the air-sending fan being rotated, the fan motor support includes a pair of support columns and has a retaining portion which is configured to press the lead wire, which is led out from the fan motor, with a bent piece against the support columns at a position below the fan motor, and to sandwich the lead wire between the support columns and the bent piece. With this configuration, the lead wire of the fan motor is led from the lead wire lead-out portion to the electrical component unit via the retaining portion of the fan motor support (for example, see Patent Literature 1).

PATENT LITERATURE

Patent Literature 1: Japanese Unexamined Patent Application Publication No. 2001-193969

The fan motor support includes the pair of support columns, which are apart from each other in the rightward-and-leftward direction by a predetermined distance and extend in an upward-and-downward direction (vertical direction). The fan motor is mounted to motor mounting surfaces formed between the pair of support columns. The fan motor has a circular shape in front view when mounting legs fixed by screws to the motor mounting surfaces of the fan motor support are excluded, and the rotary shaft projects at a center of the fan motor. The rotary shaft of the fan motor is positioned at a center between the pair of support columns in the rightward-and-leftward direction. The lead wire lead-out portion of the fan motor is formed so as to include a lowermost portion (excluding the mounting legs) of the fan motor, which is directly below the rotary shaft.

Therefore, the lead wire lead-out portion of the fan motor and the retaining portion for the lead wire provided on the support columns of the fan motor support are apart from each other in the rightward-and-leftward direction by a distance corresponding to a half of an interval between the pair of support columns, and the retaining portion of the fan motor support is positioned obliquely below the lead wire lead-out portion in front view.

As described above, the retaining portion is positioned obliquely below the lead wire lead-out portion. Therefore, the lead wire extending from the lead wire lead-out portion to the retaining portion may be sandwiched at the retaining portion under a state of being tensioned without any loose portion. In such a circumstance, the lead wire is pulled obliquely downward. Therefore, the lead wire lead-out portion, that is, a root portion of the lead wire receives, in addition to a downward pulling force, a shear force in a direction toward the side on which the retaining portion is provided in the rightward-and-leftward direction.

As the fan motor of the outdoor unit, at present, there has widely been used a DC brushless motor of a mold type. Therefore, the lead wire includes not only a power line but also a plurality of electric lines such as a position signal line for a rotator magnet, which are covered with tubes. However, the plurality of electric lines are not received in the tubes at the lead wire lead-out portion, that is, at the root portion of the lead wire, and are in a state of being arrayed in the rightward-and-leftward direction. The plurality of electric lines led out from the lead wire lead-out portion in the arrayed state are bundled together, and a bundle of electric lines bundled together is covered with a tube.

Therefore, at the lead wire lead-out portion being the root of the lead wire, a shear force applied to the electric lines arrayed in the rightward-and-leftward direction is relatively larger at the electric lines on a side far from the retaining portion than at the electric lines on a side close to the retaining portion. A ratio of the shear force with respect to the obliquely downward pulling force (resultant force) toward the retaining portion is higher on the side far from the retaining portion.

Being far from the retaining portion means that a distance in the rightward-and-leftward between a position of the retaining portion and a position of the electric line at the lead wire lead-out portion is large. Electric lines at end portions in the array having the largest distance receive the largest shear force. For example, when the retaining portion is formed on the right support column of the pair of support columns in front view, the shear force applied to the electric line positioned on the most left side in front view at the lead wire lead-out portion is largest.

In the handling structure for the lead wire of the fan motor as disclosed in Patent Literature 1, which has a configuration in which the lead wire led out from the lower portion of the fan motor is retained by the support columns of the fan motor support at a position below the fan motor, and is led from the retaining portion to the electrical component unit in the upper portion of the machine chamber, when the lead wire is retained by the support columns under the state of being tensioned without any loose portion, there is a fear in that the shear force is applied to the root of the lead wire to cause breakage of the lead wire due to the shear force. In particular, the electric line, which is provided at a position farthest from the retaining portion among the plurality of electric lines constructing the lead wire, receives relatively largely the shear force. Therefore, breakage of the electric line is concerned.

SUMMARY

The present invention has been made to solve the above-mentioned problem, and has an object to provide a highly reliable outdoor unit for an air-conditioning apparatus having a handling structure for a lead wire which prevents breakage of the lead wire of the fan motor.

According to one embodiment of the present invention, there is provided an outdoor unit for an air-conditioning apparatus, including: a partition plate for partitioning an inside of a casing in a rightward-and-leftward direction to form a fan chamber in which a heat exchanger and an air-sending fan are installed and a machine chamber in which a compressor is arranged; an electrical component unit arranged in an upper portion of the machine chamber; a fan motor, which is configured to drive the air-sending fan to rotate and includes a lead wire which is led to the electrical component unit; and a fan motor support, which is positioned between the heat exchanger and the air-sending fan and is configured to fix the fan motor, the fan motor support including: a pair of support columns, which are arranged apart from each other in the rightward-and-leftward direction and extend in an upward-and-downward direction; motor mounting surfaces, each of which is formed in a middle of the pair of support columns in the upward-and-downward direction, and is configured to receive the fan motor; an intermediate transverse plate, which is positioned above or below the motor mounting surfaces in the middle of the pair of support columns in the upward-and-downward direction and extends across the pair of support columns in the rightward-and-leftward direction; and a rightward-and-leftward direction guide piece, which is formed so as to project in a direction of approaching the fan motor from an end surface of the intermediate transverse plate on the motor mounting surface side at a position above or below the fan motor in a vertical direction at a distance apart from the fan motor under the state in which the fan motor is mounted to the motor mounting surfaces, the rightward-and-leftward direction guide piece having a rightward-and-leftward direction guide groove, which is formed so as to be opened in a direction opposite to the machine chamber in the rightward-and-leftward direction and recessed in a direction toward the machine chamber, and is configured to change a wiring path of the lead wire hooked thereto to a direction toward the machine chamber from the upward-and-downward direction.

According to one embodiment of the present invention, there can be provided the highly reliable outdoor unit for the air-conditioning apparatus having the handling structure for the lead wire which prevents breakage of the lead wire of the fan motor.

DETAILED DESCRIPTION

Embodiment 1

Figure 1:
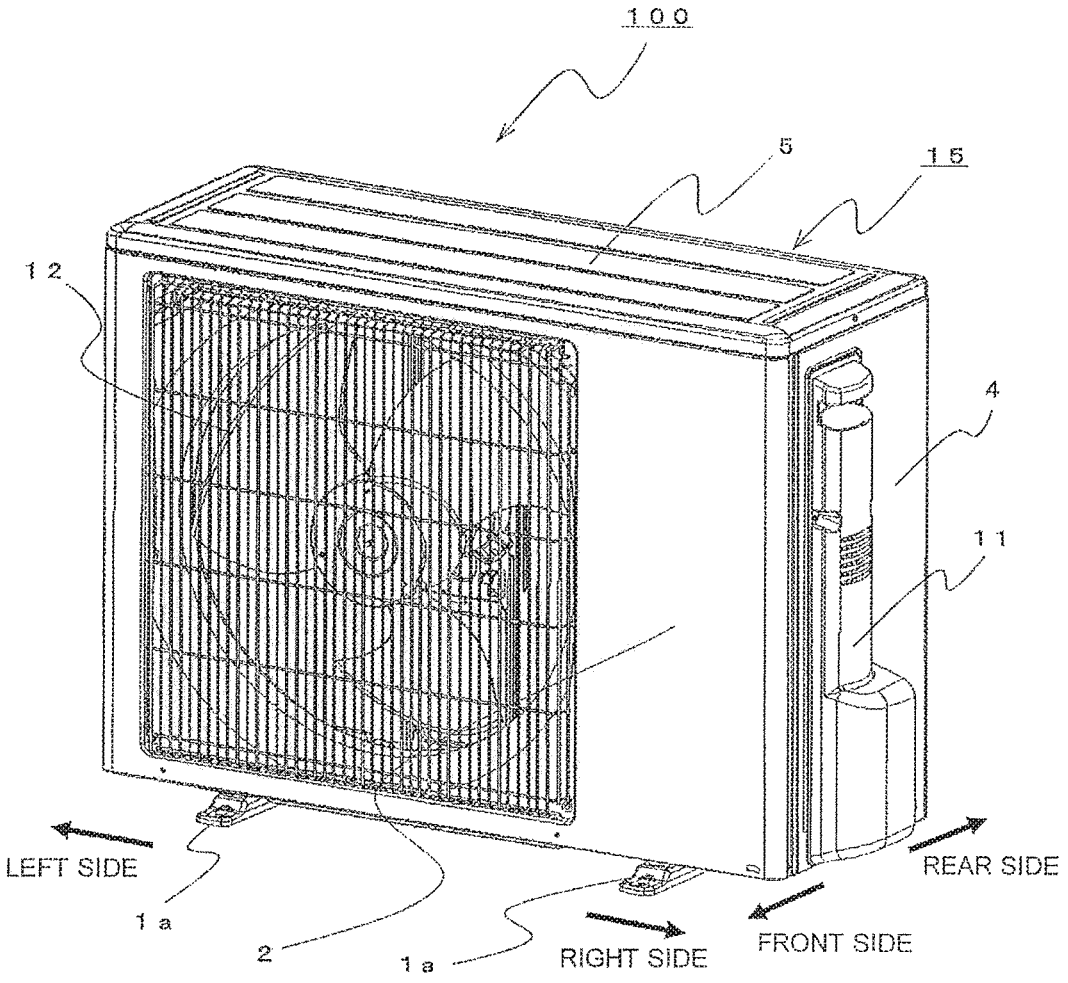
FIG. 1 is an outer appearance perspective view of an outdoor unit for an air-conditioning apparatus according to Embodiment 1 of this invention.
Figure 2:
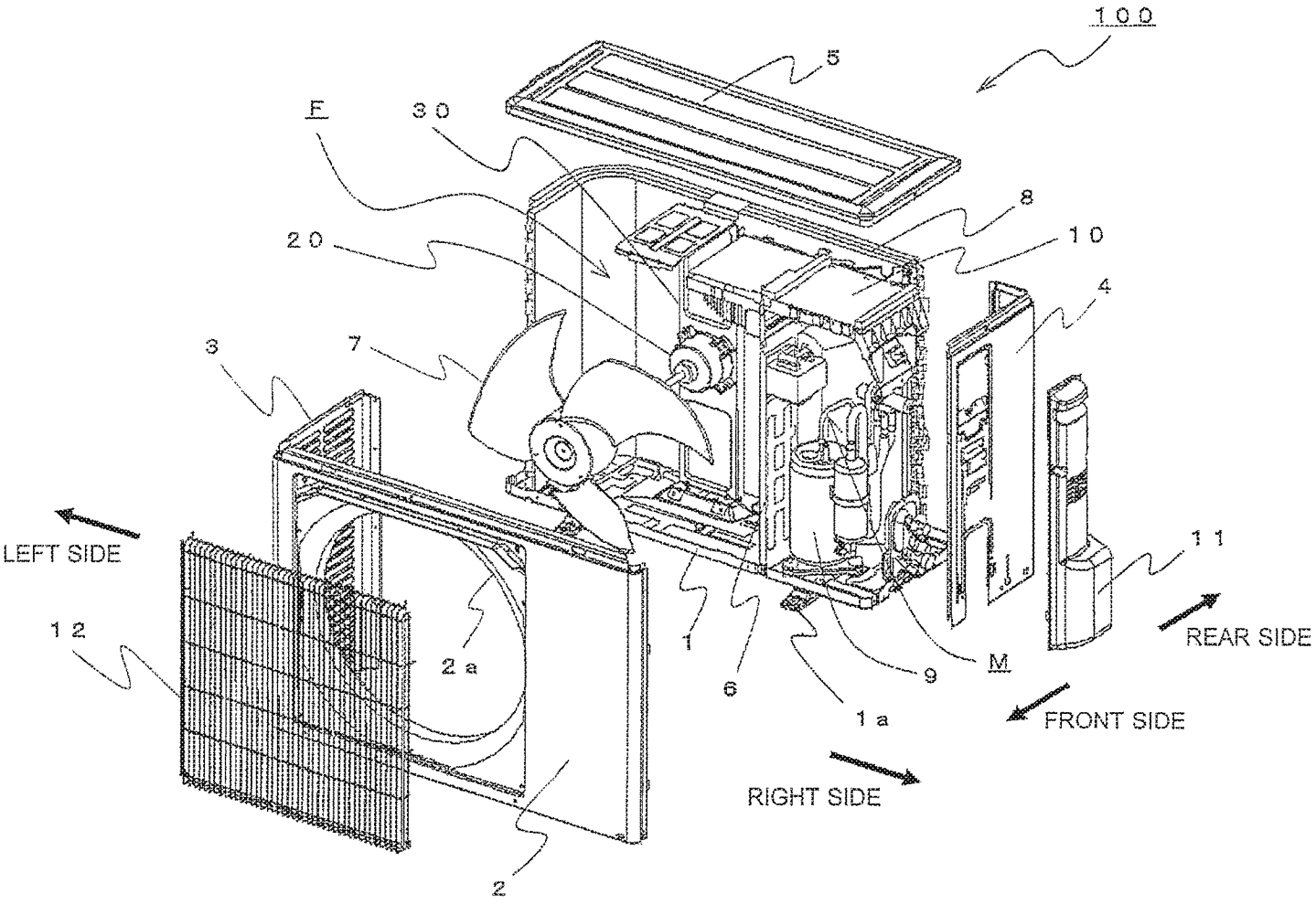
FIG. 2 is an exploded perspective view of the outdoor unit illustrated in FIG. 1.

Now, Embodiment 1 of this invention is described with reference to the drawings. FIG. 1 is an outer appearance perspective view of an outdoor unit 100 (hereinafter referred to as outdoor unit 100) for an air-conditioning apparatus according to Embodiment 1 of this invention, and FIG. 2 is an exploded perspective view of the outdoor unit 100 illustrated in FIG. 1. This outdoor unit is installed outdoors and is connected to an indoor unit installed indoors (not shown) by a refrigerant pipe, thereby constructing a refrigeration cycle. Further, the outdoor unit is also connected to the indoor unit through a power cable and a signal line to control an operation of the refrigeration cycle. The outdoor unit 100 and the indoor unit construct an air-conditioning apparatus of a separation type.

The outdoor unit 100 has an outer appearance of a substantially rectangular parallelepiped shape having long sides extending in the rightward-and-leftward direction, and a plurality of sheet metal components construct a casing 15. The casing 15 includes a bottom plate 1 being a bottom portion, a front panel 2 covering a front side, a left side panel 3 and a right side panel 4 covering the left side and the right side, respectively, and a top panel covering an upper side. The left side panel 3 is molded integrally with the front panel 2. Further, a pair of leg portions 1*a* configured to support the outdoor unit 100 are fixed to a lower surface of the bottom plate 1.

As illustrated in FIG. 2, an inside of the casing 15 of the outdoor unit 100 is partitioned in the rightward-and-leftward direction with a partition plate 6, which stands upright on an upper surface of the bottom plate 1, to form a fan chamber F in which an air-sending fan 7 and a heat exchanger 8 are arranged and a machine chamber M in which a compressor 9 and an electrical component unit 10 are arranged. The compressor 9 is installed on the bottom plate 1 through intermediation of a vibration-proof rubber, and the electrical component unit 10 is positioned in an upper portion of the machine chamber M. As illustrated in FIG. 2, the machine chamber M is formed at a position on the right side, and the fan chamber F is formed at a position on the left side, as viewed from the front side.

In the right side panel 4 facing the machine chamber M, there are formed a cutout portion for allowing a connection valve, which receives a connection pipe for connection with the indoor unit, to project rightward, and an opening for allowing a power line and the signal line from the indoor unit to pass the opening toward a terminal table, which is configured to relay the power line and the signal line to the electrical component unit 10. A protection cover 11 configured to cover the cutout and the opening is mounted to the right side panel 4.

In the fan chamber F, the heat exchanger 8 having a substantially L-shape in plan view is installed on the bottom plate 1 so that a long side portion of the L-shape is positioned closer to the rear side of the outdoor unit 100, and so that a short side portion of the L-shape is positioned closer to the left side of the fan chamber F. The air-sending fan 7 is arranged in front of the long side portion of the heat exchanger 8. Further, the front panel 2 positioned in front of the air-sending fan 7 has an air outlet 2*a* opposed to the air-sending fan 7, and a fan guard 12 is mounted on a front side of the air outlet 2*a*.

The left side panel 3 has a plurality of ventilation holes, and an air flow, which is generated through the rotation of the air-sending fan 7 is caused to pass through the heat exchanger 8, and is caused to blow out through the air outlet 2*a*. The air-sending fan 7 is positioned downstream of the heat exchanger 8 along the air flow generated by the air-sending fan 7.

The air-sending fan 7 is a propeller fan including a plurality of blades, which are provided on an outer periphery of a center boss portion at equal intervals in a circumferential direction. The air-sending fan 7 is rotated by a rotational drive force of the fan motor 20 being a DC brushless motor of a mold type. The fan motor 20 includes a rotary shaft 21 projecting toward a front side, and the rotary shaft 21 is connected to a center of the boss portion of the air-sending fan 7. The rotational drive force of the fan motor 20 is transmitted to the air-sending fan 7 through the rotary shaft 21 so that the air-sending fan 7 is rotated.

The fan motor 20 configured to drive the air-sending fan 7 to rotate thereof is fixed to a fan motor support 30 positioned on a rear side of the air-sending fan 7 and on a front side of the long side portion of the heat exchanger 8. The fan motor 20 is positioned on the rear side of the air-sending fan 7. The fan motor support 30 has a bottom portion fixed to the bottom plate 1, and is positioned between the air-sending fan 7 and the heat exchanger 8 in the frontward-and-backward direction. The fan motor support 30 is configured to support not only the fan motor 20 but also the air-sending fan 7 connected to the rotary shaft 21 of the fan motor 20.

Figure 3:
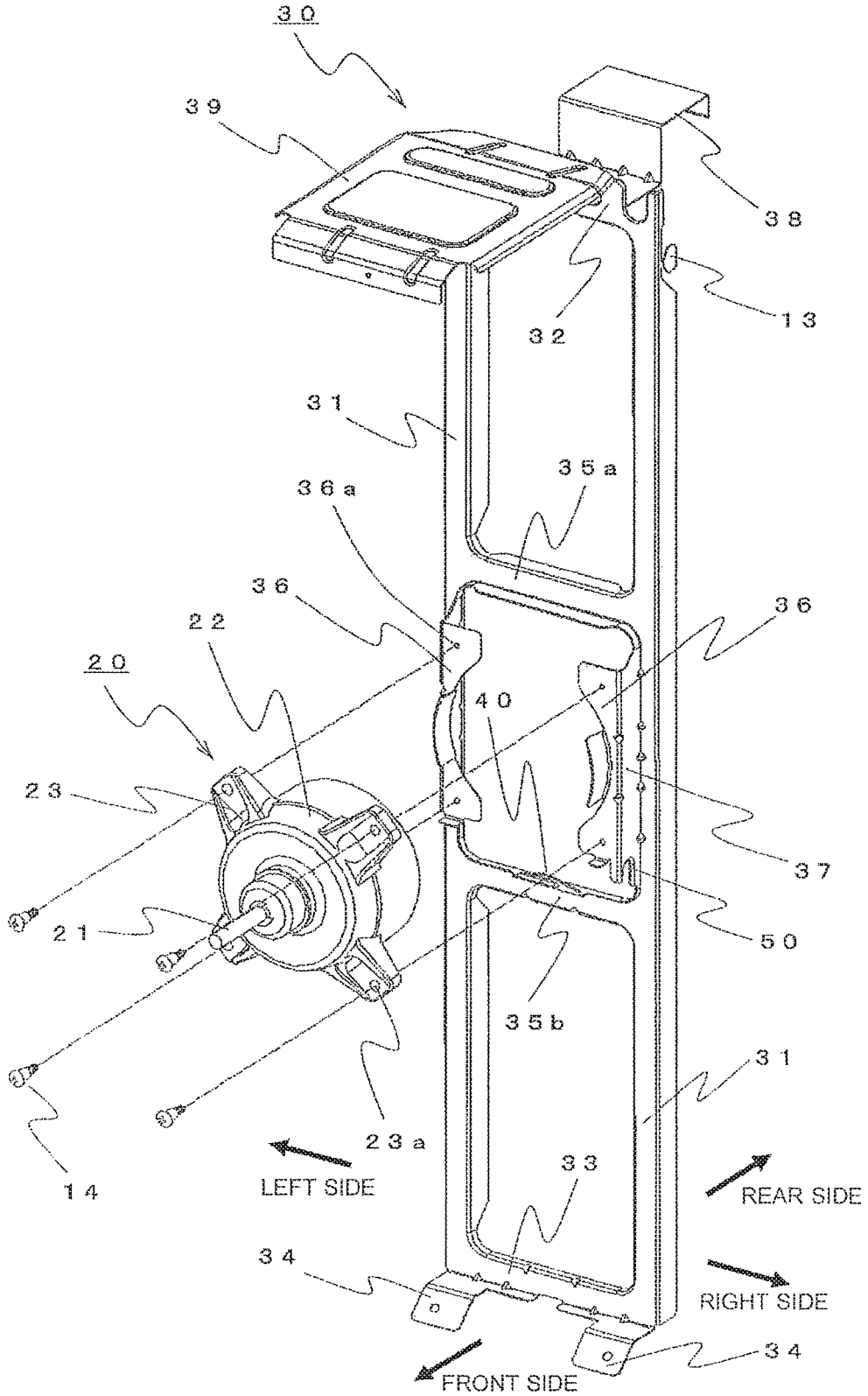
FIG. 3 is an exploded perspective view for illustrating a fan motor and a fan motor support in the outdoor unit illustrated in FIG. 1 as viewed from a front side of the fan motor support.
Figure 4:
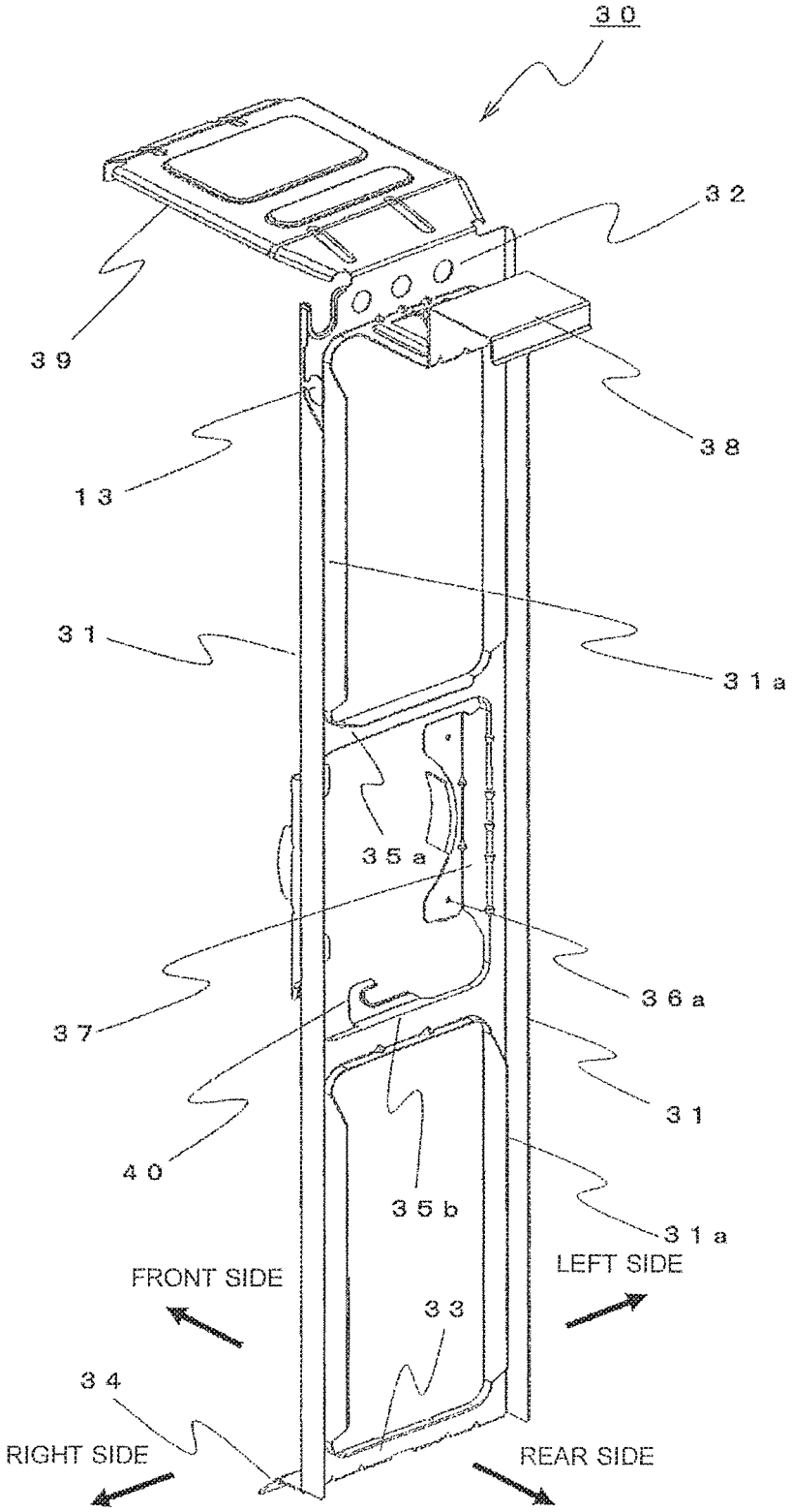
FIG. 4 is a perspective view of the fan motor support in the outdoor unit illustrated in FIG. 1 as viewed from a rear side of the fan motor support.

FIG. 3 and FIG. 4 are perspective views of the fan motor support 30. In FIG. 3 and FIG. 4, the fan motor support 30 is viewed from different directions. In FIG. 3, the fan motor 20 is also illustrated. The fan motor support 30 is made of sheet metal, and is integrally molded. The fan motor support 30 includes a pair of support columns 31, which are apart from each other in the rightward-and-leftward direction at a predetermined interval and extend in the upward-and-downward direction. The upward-and-downward direction, in which the pair of support columns 31 extend, is substantially the vertical direction.

Further, the fan motor support 30 includes an upper transverse plate 32 and a lower transverse plate 33, which are formed so as to extend across the pair of support columns 31 in the rightward-and-leftward direction at an upper end portion and a lower end portion of the pair of support columns 31. Fixing plates 34 which project toward the front side of the outdoor unit 100 are connected to the lower transverse plate 33. The fixing plates 34 are fixed by screws to the bottom plate 1 so that the fan motor support 30 stands upright on the bottom plate 1.

Further, in the middle of the pair of support columns 31 in the upward-and-downward direction between the upper transverse plate 32 and the lower transverse plate 33, there are formed two intermediate transverse plates 35*a* and 35*b*. The intermediate transverse plates 35*a* and 35*b* are arranged at a predetermined interval in the upward-and-downward direction and extend in the rightward-and-leftward direction across the pair of support columns 31. The upper intermediate transverse plate 35*a* is arranged closer to the upper transverse plate 32, and the lower intermediate transverse plate 35*b* is arranged closer to the lower transverse plate 33. Front surfaces of the upper transverse plate 32, the lower transverse plate 33, and the two intermediate transverse plates 35*a* and 35*b* are flush with front surfaces of the pair of support columns 31.

Motor mounting surfaces 36, which project toward the front side of the outdoor unit 100 with respect to the pair of support columns 31, are formed at a position in the middle of the fan motor support 30, in this case, which is a substantially center position, in the upward-and-downward direction between the two intermediate transverse plates 35*a* and 35*b*. The motor mounting surfaces 36 are flat surfaces opposed to the air outlet 2*a* of the front panel 2, and are formed in the middle of the pair of support columns 31 in the upward-and-downward direction and between the pair of support columns 31 in the rightward-and-leftward direction. Further, the motor mounting surfaces 36 each have a plurality of screw holes 36*a*. The upper intermediate transverse plate 35*a* is positioned above the motor mounting surfaces 36 at a predetermined interval in the upward-and-downward direction. The lower intermediate transverse plate 35*b* is positioned below the motor mounting surfaces 36 at a predetermined interval in the upward-and-downward direction.

In each of the pair of support columns 31, both the right and left sides are bent toward the rear side at portions between the upper transverse plate 32 and the upper intermediate transverse plate 35*a* and between the lower intermediate transverse plate 35*b* and the lower transverse plate 33 so that a cross section thereof is formed into a U-shape being opened on the rear side. Therefore, at those portions, each support column 31 has a support column back groove 31*a* in which both the right and left sides and the front side are closed, and are opened on the rear side.

Between the two intermediate transverse plates 35*a* and 35*b*, the outer sides thereof are bent toward the rear side similarly to the portions having the support column back grooves 31*a* to form flat surfaces being continuous with the upper and lower portions. However, the inner sides are bent toward the front side to form standing walls 37 which connect the support columns 31 and the motor mounting surfaces 36 to each other. Therefore, between the two intermediate transverse plates 35*a* and 35*b*, each of the pair of support columns 31 has a cross section of an L-shape formed of two surfaces on the outer side and the front side. The standing walls 37, which project toward the front side, are substantially perpendicular to the front surfaces of the support columns 31, and the motor mounting surfaces 36 are parallel to the front surfaces of the support columns 31, and are positioned more on the front side than the front surfaces of the support columns 31 by the height of the standing walls 37.

In an upper portion of the support column 31 of the pair of support columns 31, which is positioned on the machine chamber M side, a lead wire pressing piece 13 is formed by bending. The lead wire pressing piece 13 is configured to press to retain a lead wire 25 of the fan motor 20, which is led to the lead wire pressing piece 13. The lead wire 25 is described later in detail.

On an upper portion of the fan motor support 30, there is formed a heat exchanger fixing portion 38 which is continuous with a lower end of the upper transverse plate 32 and projects toward the rear side. The heat exchanger fixing portion 38 has a fitting portion having a U-shaped cross section being open downward, and an upper end portion of the long side portion of the heat exchanger 8 is fitted into the fitting portion. With this configuration, the heat exchanger 8 stands upright stably.

Further, the fan motor support 30 includes a top plate 39 which is continuous with the upper end of the upper transverse plate 32 and projects toward the front side. The top plate 39 has a contact surface which is bent downward at a distal end of the top plate 39, and a screw hole is formed in the contact surface. The contact surface is brought into contact with a rear surface of the front panel 2, and the top plate 39 is fixed by a screw to the front panel 2. With this configuration, the top panel 5 is reinforced by the top plate 39 provided on the lower side. Accordingly, even when a load is applied from above the top panel 5, for example, in a case of stacking, deformation of the top panel 5 may be prevented. Further, the top plate 39 is fixed by a screw to the front panel 2. Accordingly, the fan motor support 30 stands upright stably. A cushioning material configured to absorb an impact load is sandwiched between the top panel 5 and the top plate 39.

As illustrated in FIG. 3, the fan motor 20 has an outer appearance in which four mounting legs 23 are arranged at intervals of 90 degrees and radially project from an outer periphery of a cylindrical main body portion 22, and in which the rotary shaft 21 projects from the front side of the main body portion 22. The outer periphery of the main body portion 22 is formed of a mold resin which covers a motor stator and a circuit board (not shown). The main body portion 22 has a circular shape in front view, and a center of the main body portion 22 and a center of the rotary shaft 21 match with each other. The rotary shaft 21 has one end connected to the air-sending fan 7 and another end connected to a motor rotator positioned on an inner peripheral side of the motor stator.

The mounting legs 23 each project outward in a radial direction at a position closer to the front side of the cylindrical main body portion 22 and have a screw passing hole 23*a* at a position closer to an outer side. Rear surfaces of the four mounting legs 23 are brought into contact with the motor mounting surfaces 36 of the fan motor support 30 and are mounted and fixed to the motor mounting surfaces 36 of the fan motor support 30 by four screws 14 screwed through the screw passing holes 23*a* into the screw holes 36*a*. In FIG. 3, illustration of the lead wire 25 of the fan motor 20 is omitted.

In the outdoor unit 100, the heat exchanger 8 is installed on the bottom plate 1, and then, the fan motor support 30 is fixed to the bottom plate 1, and an upper portion of the heat exchanger 8 is fitted to the heat exchanger fixing portion 38. After that, the fan motor 20 is mounted to the motor mounting surfaces 36 from the front side, and the air-sending fan 7 is connected to the rotary shaft 21 of the fan motor 20.

Figure 5:
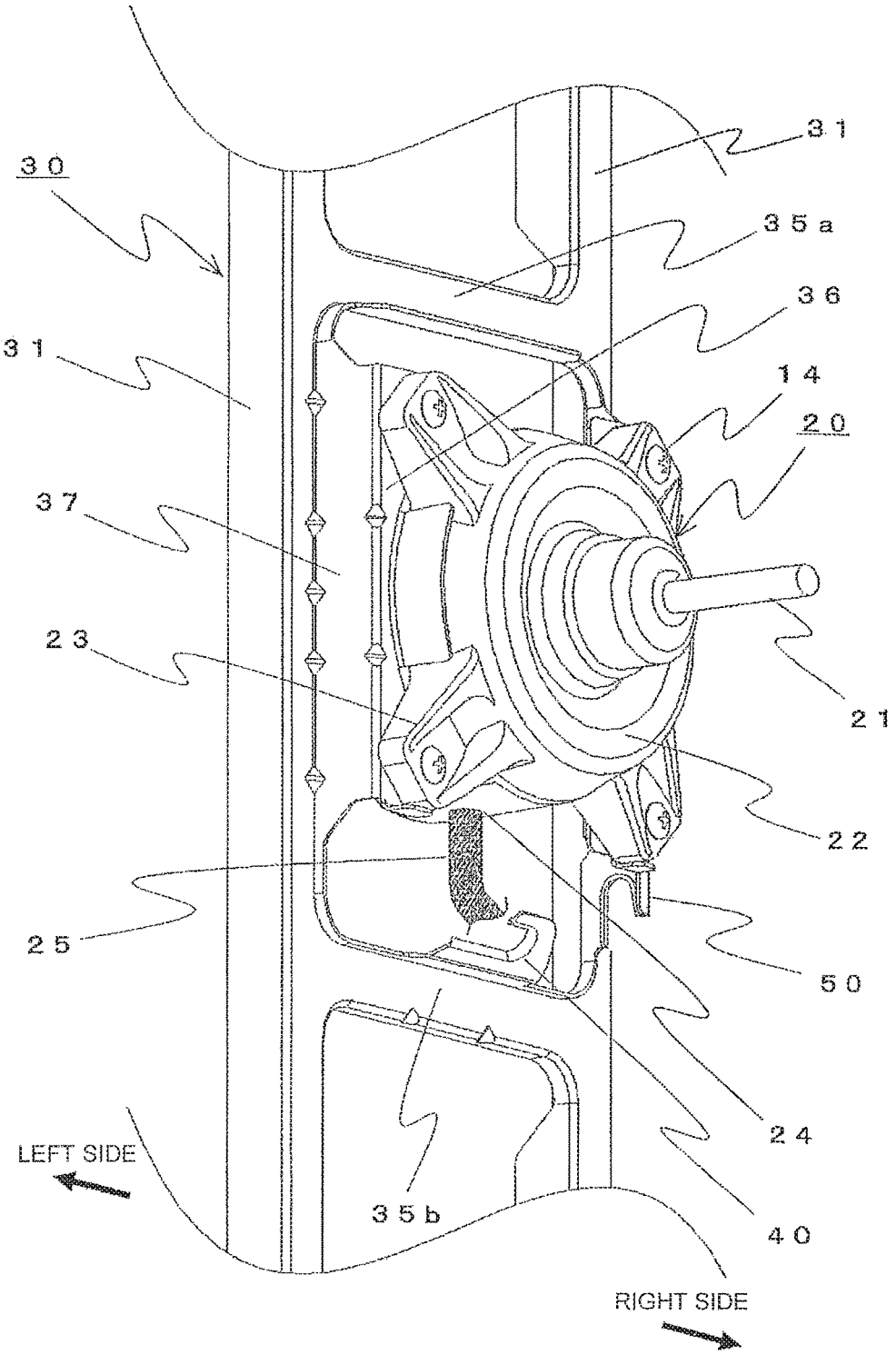
FIG. 5 is a perspective view of the fan motor in a state of being mounted to the fan motor support illustrated in FIG. 3.
Figure 6:
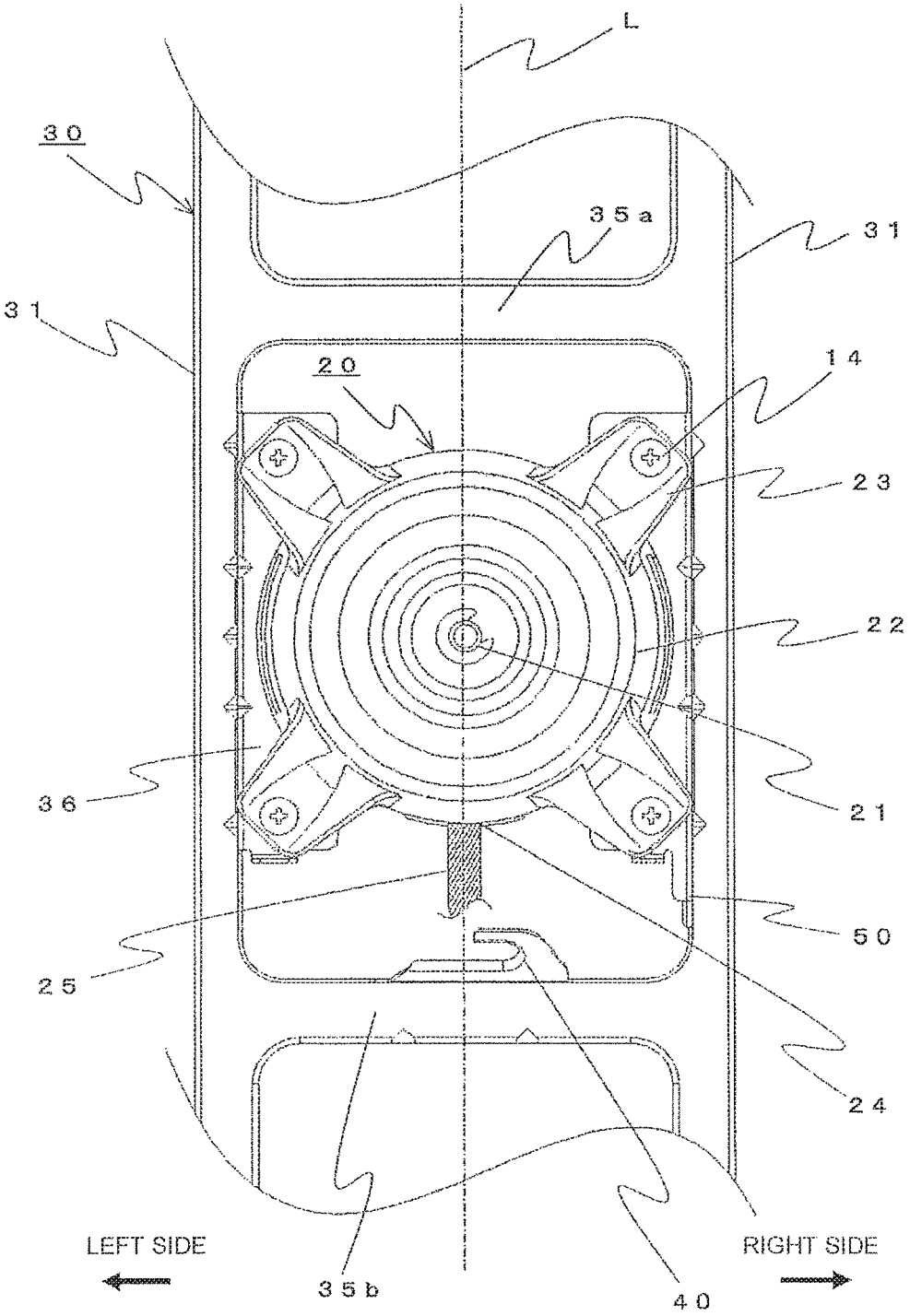
FIG. 6 is a front view of the fan motor in the state of being mounted to the fan motor support illustrated in FIG. 3.

FIG. 5 is a perspective view of the fan motor 20 in a state of being mounted to the fan motor support 30, and FIG. 6 is a front view thereof. The fan motor 20 includes the lead wire 25, which is led to the electrical component unit 10 and connected to a connector on an electric board contained in the electrical component unit 10. The fan motor 20 includes a lead wire lead-out portion 24 formed in the outer periphery of the main body portion 22, and the lead wire 25 is led out from the lead wire lead-out portion 24. In the outdoor unit 100, the lead wire lead-out portion 24 is formed at a position of a lower end of the main body portion 22 in front view. In FIG. 5, only a part of the lead wire 25 extending from the lead wire lead-out portion 24 is illustrated. Further, a one-dot chain line illustrated in FIG. 6 indicates a center line L of the fan motor support 30 in the rightward-and-leftward direction.

The fan motor 20 is a DC brushless motor. Therefore, the lead wire 25 is covered with a tube under a state in which not only a power line but also a plurality of electric lines such as a position signal line for a rotator magnet are bundled together. Although detailed illustration is not given in FIG. 5, the plurality of electric lines are not received in the tube at the lead wire lead-out portion 24 but are in a state of being arrayed in the rightward-and-leftward direction in front view of the outdoor unit 100. The plurality of electric lines in the state of being arrayed are connected to a connector on the circuit board in the mold resin. At the lead wire lead-out portion 24, the plurality of electric lines in the state of being arrayed are led out from the mold resin. The plurality of electric lines led out from the lead wire lead-out portion 24 in the state of being arrayed are bundled together, and the bundle of electric lines bundled together is covered with a tube.

Therefore, the plurality of lines of the lead wire 25 are exposed in a region of several millimeters (from 2 mm to 3 mm) from the lead wire lead-out portion 24 to the portion covered with the tube. There has been given a DC brushless fan motor including the lead wire lead-out portion 24 at which a plurality of electric lines being arrayed do not directly project from the mold resin covering the main body portion 22 but are led out from a connector partially projecting from the mold resin. The present invention is applicable to any of those specifications.

In the main body portion 22 of the fan motor 20, the circuit board is positioned on the rear side of the motor stator, that is, on a side opposite to the side on which the rotary shaft 21 is provided. Therefore, when the rotary shaft 21 is provided on the front side of the main body portion 22, the lead wire lead-out portion 24 is provided at a position closer to the rear side of the main body portion 22 in an outer peripheral surface of the main body portion 22, which is covered with the mold resin. As illustrated in FIG. 6, the fan motor 20 is mounted to the fan motor support 30 so that the lead wire lead-out portion 24 is positioned at the lower end of the main body portion 22.

The center of the rotary shaft 21, which is the center of the front surface of the fan motor 20, is positioned substantially on the center line L. The center of the lead wire lead-out portion 24 in the rightward-and-leftward direction substantially matches with the center of the rotary shaft 21 in the upward-and-downward direction. That is, the fan motor 20 is fixed to the motor mounting surfaces 36 so that the lead wire lead-out portion 24 is positioned at the lower portion of the main body portion 22 across the center line L in the rightward-and-leftward direction.

Figure 7:
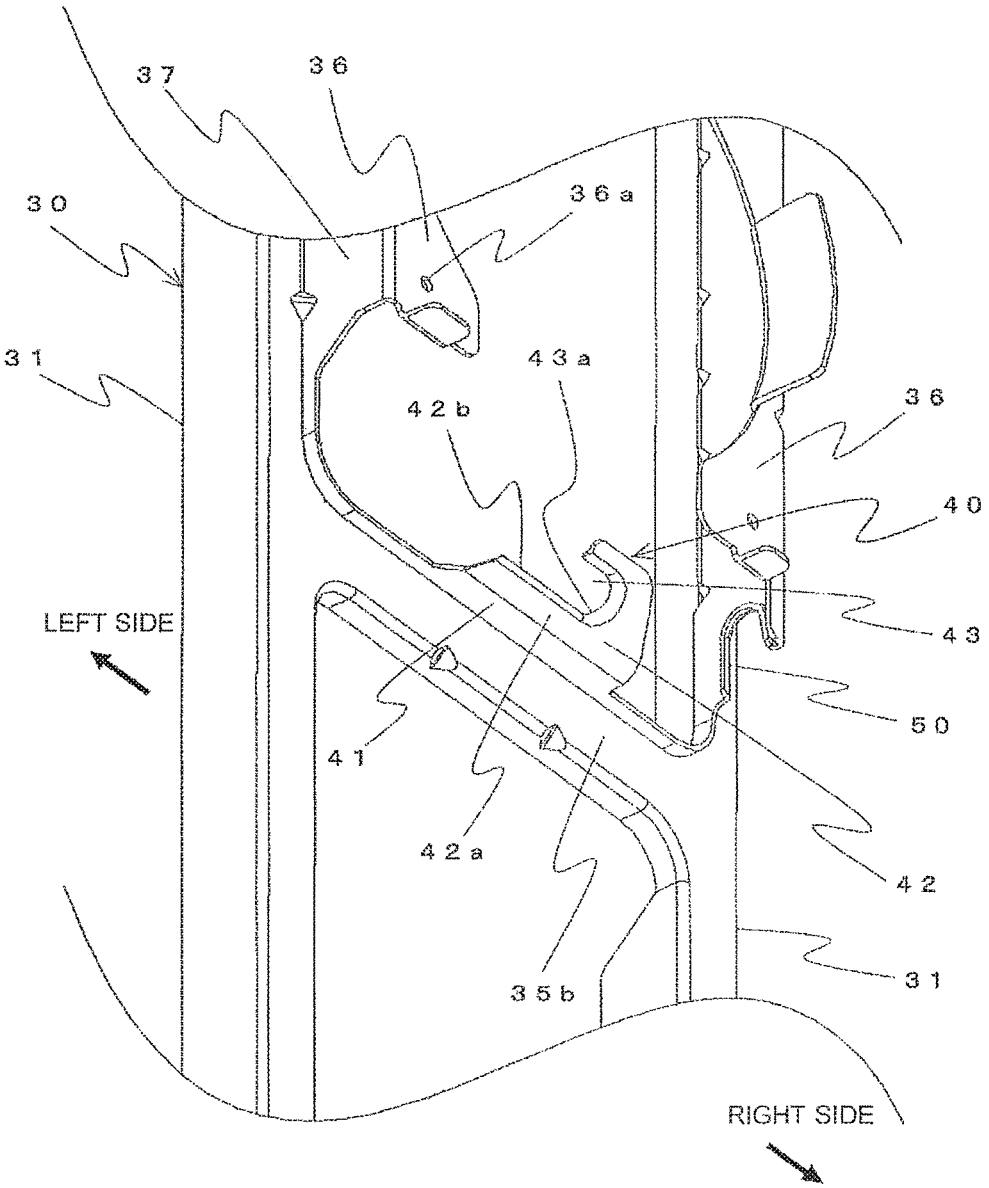
FIG. 7 is a perspective view for illustrating a rightward-and-leftward direction guide piece of the fan motor support illustrated in FIG. 3 and peripheral portions thereof.
Figure 8:
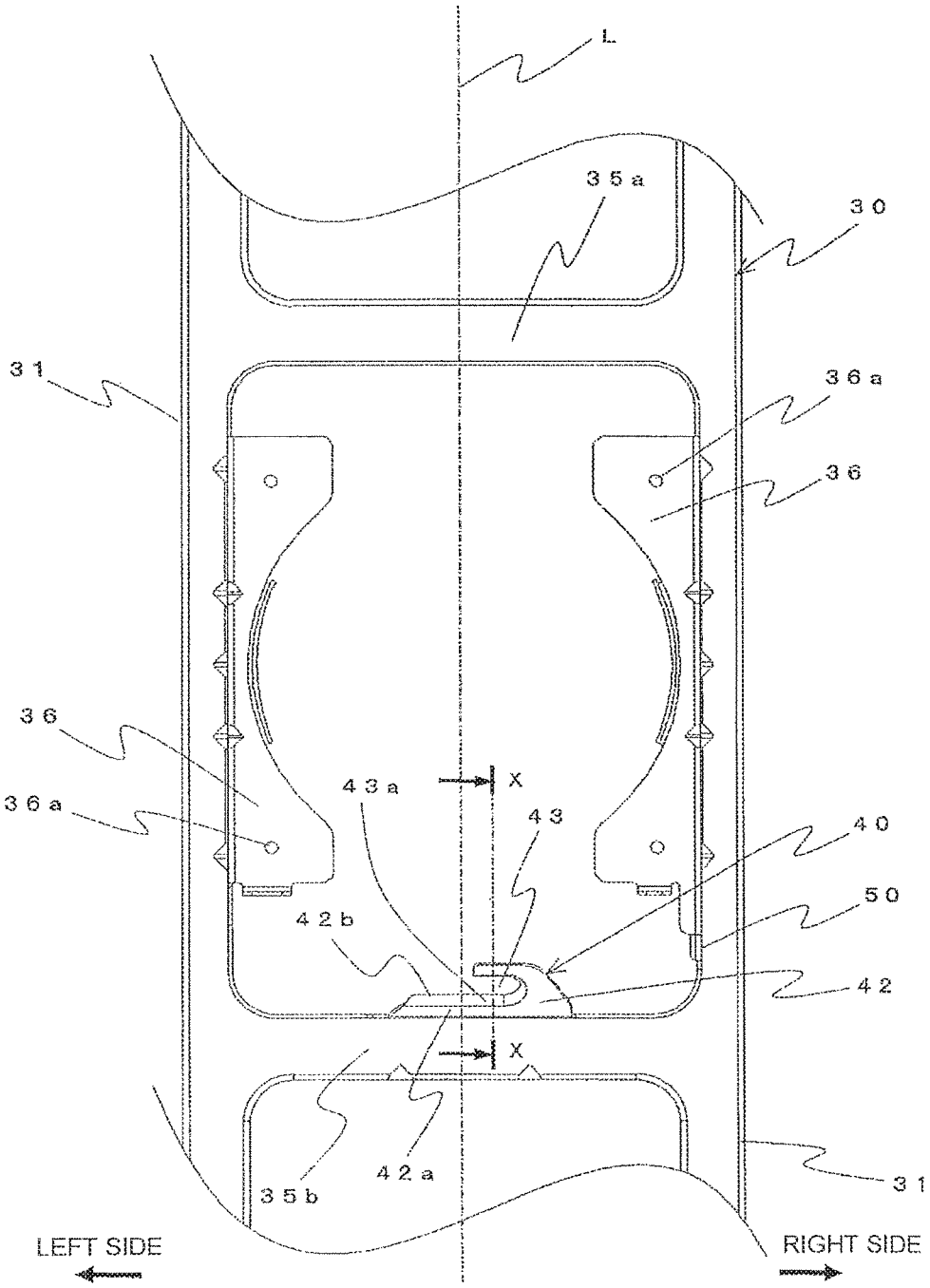
FIG. 8 is a front view of the rightward-and-leftward direction guide piece illustrated in FIG. 7.
Figure 9:
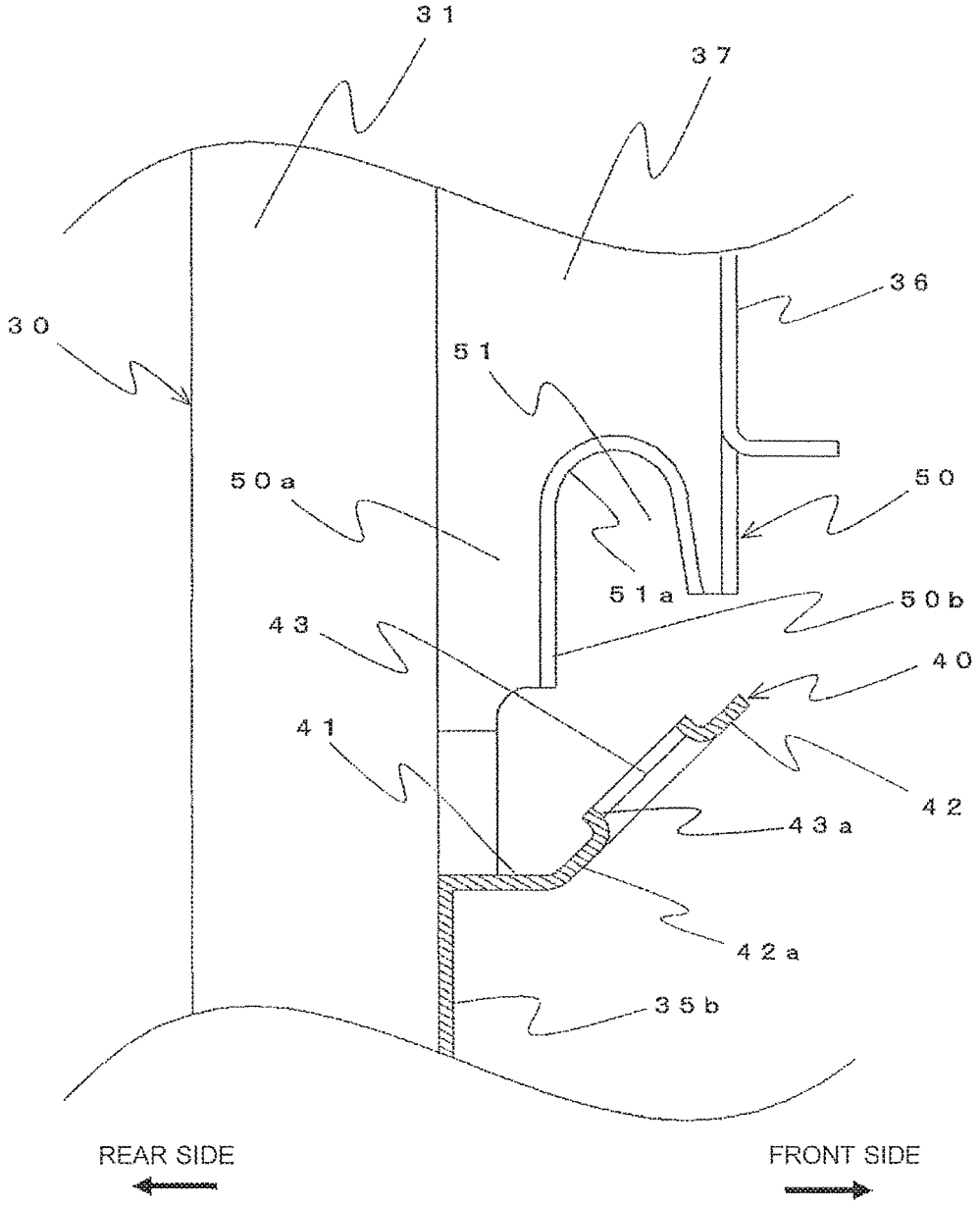
FIG. 9 is a vertical sectional view of the rightward-and-leftward direction guide piece illustrated in FIG. 7.

Now, description is made of a handling structure for the lead wire 25 of the fan motor 20 in the outdoor unit 100. In FIG. 7 to FIG. 9, a rightward-and-leftward direction guide piece 40 of the fan motor support 30, which is relevant to the lead wire handling structure, is illustrated. Description is first made of a structure of the rightward-and-leftward direction guide piece 40 with reference to FIG. 7 to FIG. 9. FIG. 7 is a perspective view for illustrating the rightward-and-leftward direction guide piece 40, which is formed so as to be continuous with the upper end of the lower intermediate transverse plate 35*b*, and peripheral portions thereof. FIG. 8 is a front view of the rightward-and-leftward direction guide piece 40. FIG. 9 is a sectional view taken along the line X-X of FIG. 8.

As illustrated in FIG. 7 to FIG. 9, the rightward-and-leftward direction guide piece 40 is formed so as to be continuous with the upper end of the lower intermediate transverse plate 35*b* and includes a projection portion 41 and a guide portion 42. The projection portion 41 is bent from the upper end of the lower intermediate transverse plate 35*b* substantially at a right angle with respect to the lower intermediate transverse plate 35*b* and projects toward the front side. The guide portion 42 is continuous with a distal end of the projection portion 41 and is bent obliquely toward the side on which the motor mounting surfaces 36 are positioned, in this case, obliquely upward. As illustrated in FIG. 9, the guide portion 42 is continuous with the distal end of the projection portion 41, and the guide portion 42 is inclined, in this case, at an angle of 45 degrees with respect to the projecting direction of the projection portion 41 toward the motor mounting surface 36 side.

The guide portion 42 has a rightward-and-leftward direction guide groove 43, which is a U-shaped groove being opened in the rightward-and-leftward direction and extending in the rightward-and-leftward direction. The rightward-and-leftward direction guide groove 43 is a U-shaped groove being opened in a direction opposite to the machine chamber M in the rightward-and-leftward direction and being recessed toward the machine chamber M. In this case, the rightward-and-leftward direction guide groove 43 is opened in the leftward direction and recessed in the rightward direction. FIG. 9 is a vertical sectional view which includes an illustration of the rightward-and-leftward direction guide groove 43, and the rightward-and-leftward direction guide piece 40 is viewed in the rightward direction. A projection end of the guide portion 42 corresponds to a projection end of the rightward-and-leftward direction guide piece 40. The guide portion 42 has the rightward-and-leftward direction guide groove 43 and the projection end of the rightward-and-leftward direction guide piece 40.

The straight line illustrated with the one-dot chain line in FIG. 8 is the center line L of the fan motor support 30 in the rightward-and-leftward direction and is the same as the center line L of FIG. 6. As illustrated in FIG. 8, the rightward-and-leftward direction guide groove 43 is positioned on the machine chamber M side from the center line L. A position of the opening of the rightward-and-leftward direction guide groove 43, which is oriented toward the side opposite to the machine chamber M, is also on the machine chamber M side from the center line L.

The projection portion 41 is formed so as to extend across the center line L in the rightward-and-leftward direction. A guide portion root portion 42*a*, which is located on the projection portion 41 side from the rightward-and-leftward direction guide groove 43 in the guide portion 42 and is continuous with the projection portion 41, is formed so as to extend across the center line L in the rightward-and-leftward direction similarly to the projection portion 41. That is, the guide portion root portion 42*a* extends beyond the rightward-and-leftward direction guide groove 43 in an opening direction of the rightward-and-leftward direction guide groove 43, which is the leftward direction in this case, and has not only a part of a U-shaped groove edge 43*a* of the rightward-and-leftward direction guide groove 43 but also a distal end edge 42*b* being continuous to the groove edge 43*a* without a step. Therefore, the distal end edge 42*b* of the guide portion root portion 42*a* and the groove edge 43*a* of the rightward-and-leftward direction guide groove 43 are continuous with each other to form a J-shape.

Both the groove edge 43*a* and the distal end edge 42*b* are bent in a direction toward the rear side, specifically, are bent toward the motor mounting surface 36 side as the guide portion 42 is inclined toward the motor mounting surface 36 side with respect to the projecting direction of the projection portion 41. Corner portions (bent portions) of the groove edge 43*a* and the distal end edge 42*b* have a curved shape (round shape). As in a case where a flange is formed on a hole edge by burring, the groove edge 43*a* and the distal end edge 42*b* being continuous with the groove edge 43*a* project like a flange in the direction toward the rear side.

Figure 10:
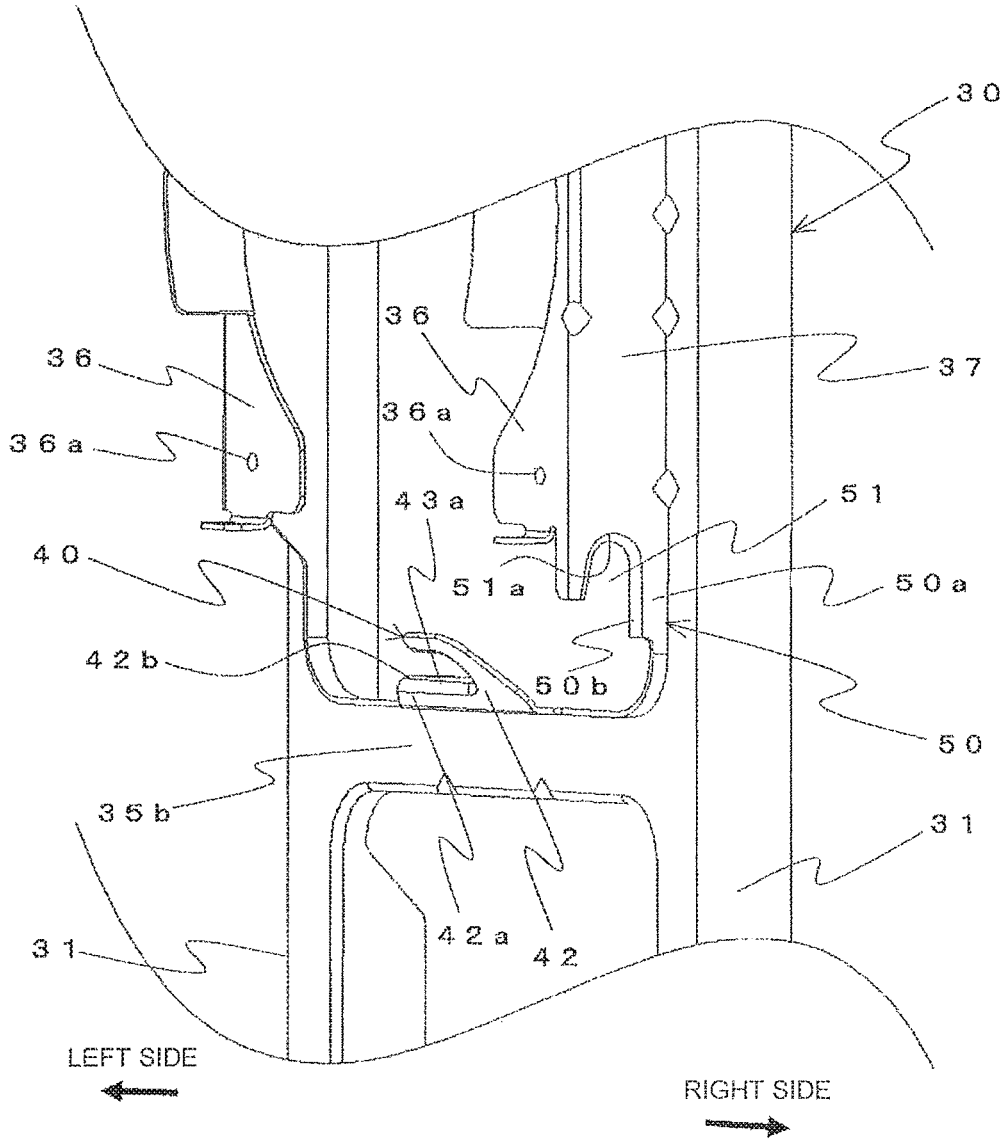
FIG. 10 is a perspective view for illustrating an upward direction guide piece of the fan motor support illustrated in FIG. 3 and peripheral portions thereof.

Next, with reference to FIG. 10, description is made of a structure of an upward direction guide piece 50 of the fan motor support 30, which is also relevant to the lead wire handling structure. FIG. 10 is a perspective view of the upward direction guide piece 50 and peripheral portions thereof.

As illustrated in FIG. 10, the upward direction guide piece 50 is formed so as to be continuous with the support column 31 of the pair of support columns 31, which is positioned on the machine chamber M side corresponding to the right side in front view in this case, be bent from the inner side toward the front side of the support column 31 to project toward the front side. The upward direction guide piece 50 in this case is formed to extend continuously with the standing wall 37 from the lower end of the standing wall 37. That is, the upward direction guide piece 50 is formed integrally with the standing wall 37. However, the upward direction guide piece 50 may be formed separately from the standing wall 37 in the upward-and-downward direction so as to be independent from the standing wall 37.

The upward direction guide piece 50 has an upward direction guide groove 51, which is a U-shaped groove being opened toward the bottom plate 1 side, that is, being opened downward. The upward direction guide groove 51 is formed above the rightward-and-leftward direction guide groove 43 in the upward-and-downward direction. Further, also in the upward direction guide piece 50, a root portion 50*a* being continuous with the support column 31 extends beyond the upward direction guide groove 51 in an opening direction of the upward direction guide groove 51, that is, extends downward, and has not only a part of the groove edge 51*a* (U-shape) of the upward direction guide groove 51 but also a front end edge 50*b* being continuous with the groove edge 51*a* without a step. Therefore, the front end edge 50*b* and the groove edge 51*a* are continuous with each other to form a J-shape. It should be noted that, in this case, as described above, the upward direction guide piece 50 is formed integrally with the standing wall 37. Therefore, it can be said that the upward direction guide groove 51 being opened downward is formed in the lower portion of the standing wall 37.

Further, the groove edge 51*a* and the front end edge 50*b*, which are continuous with each other, are bent toward the inner side, that is, in the direction opposite to the direction of the machine chamber M in the rightward-and-leftward direction, and project in a flange shape. Corner portions (bent portions) of the groove edge 51*a* and the front end edge 50*b* have a curved shape (round shape) similarly to the rightward-and-leftward direction guide piece 40.

Figure 11:
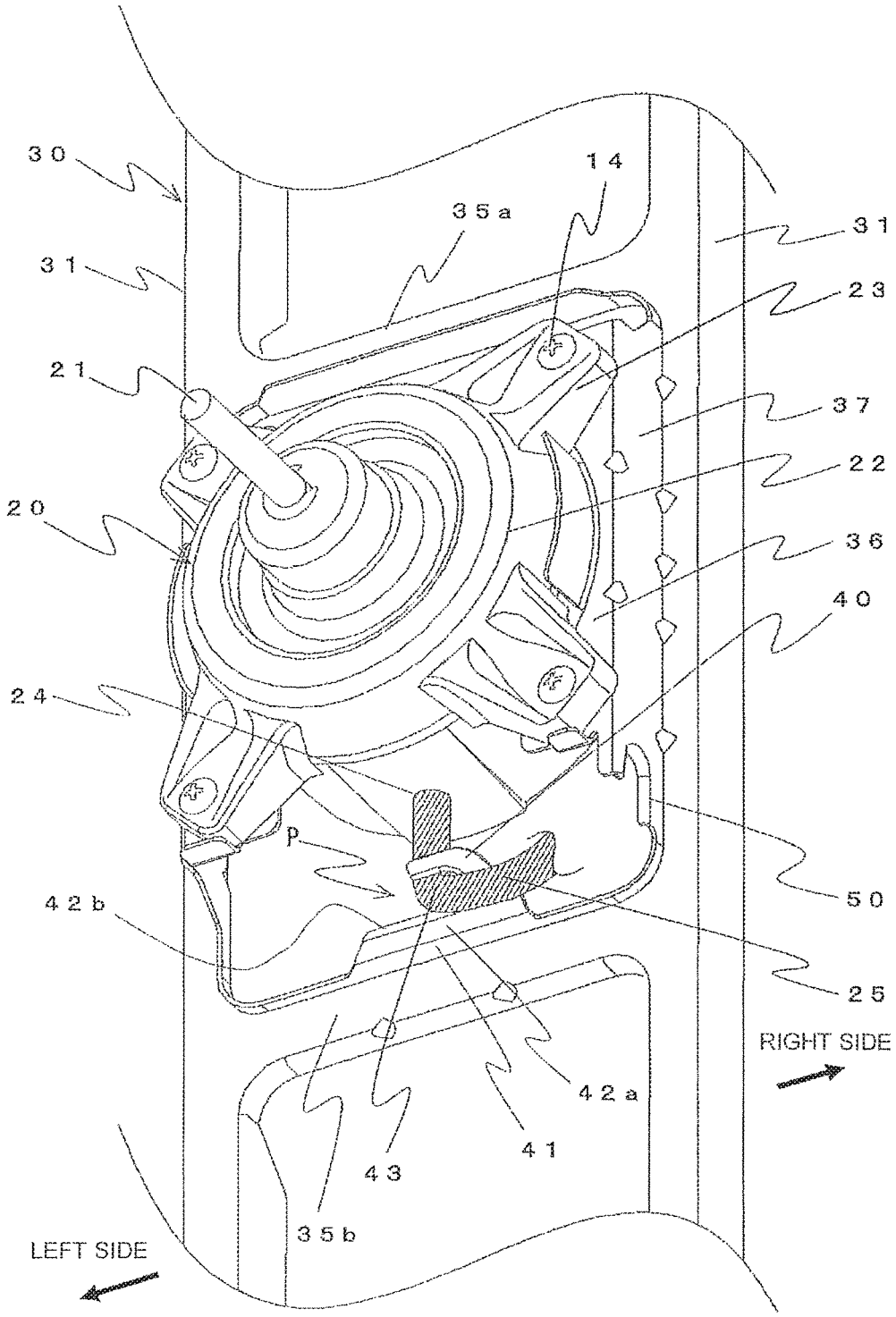
FIG. 11 is a perspective view for illustrating a first direction-changing portion of a lead wire handling structure in the outdoor unit illustrated in FIG. 1.
Figure 12:
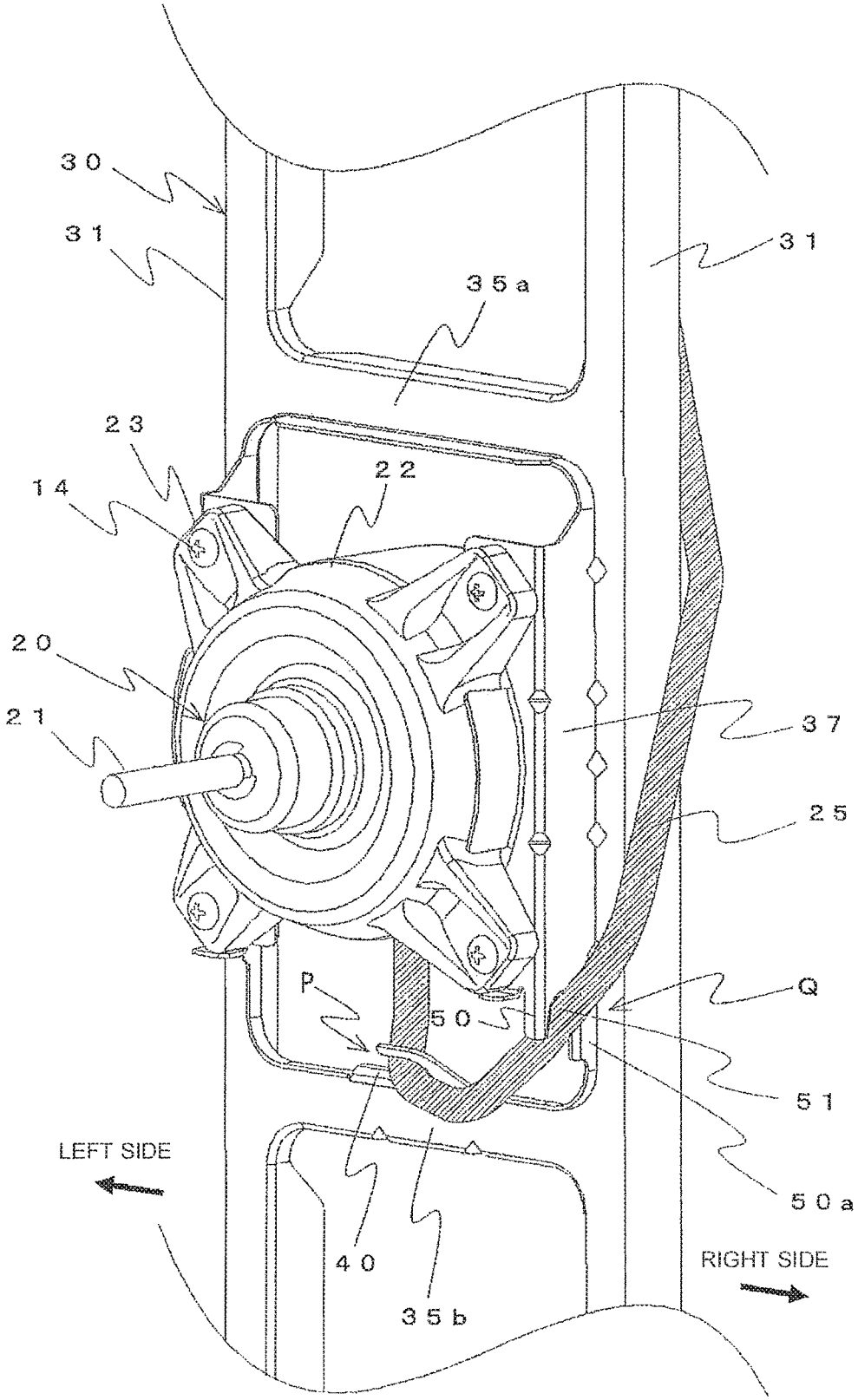
FIG. 12 is a perspective view for illustrating a second direction-changing portion of the lead wire handling structure in the outdoor unit illustrated in FIG. 1.
Figure 13:
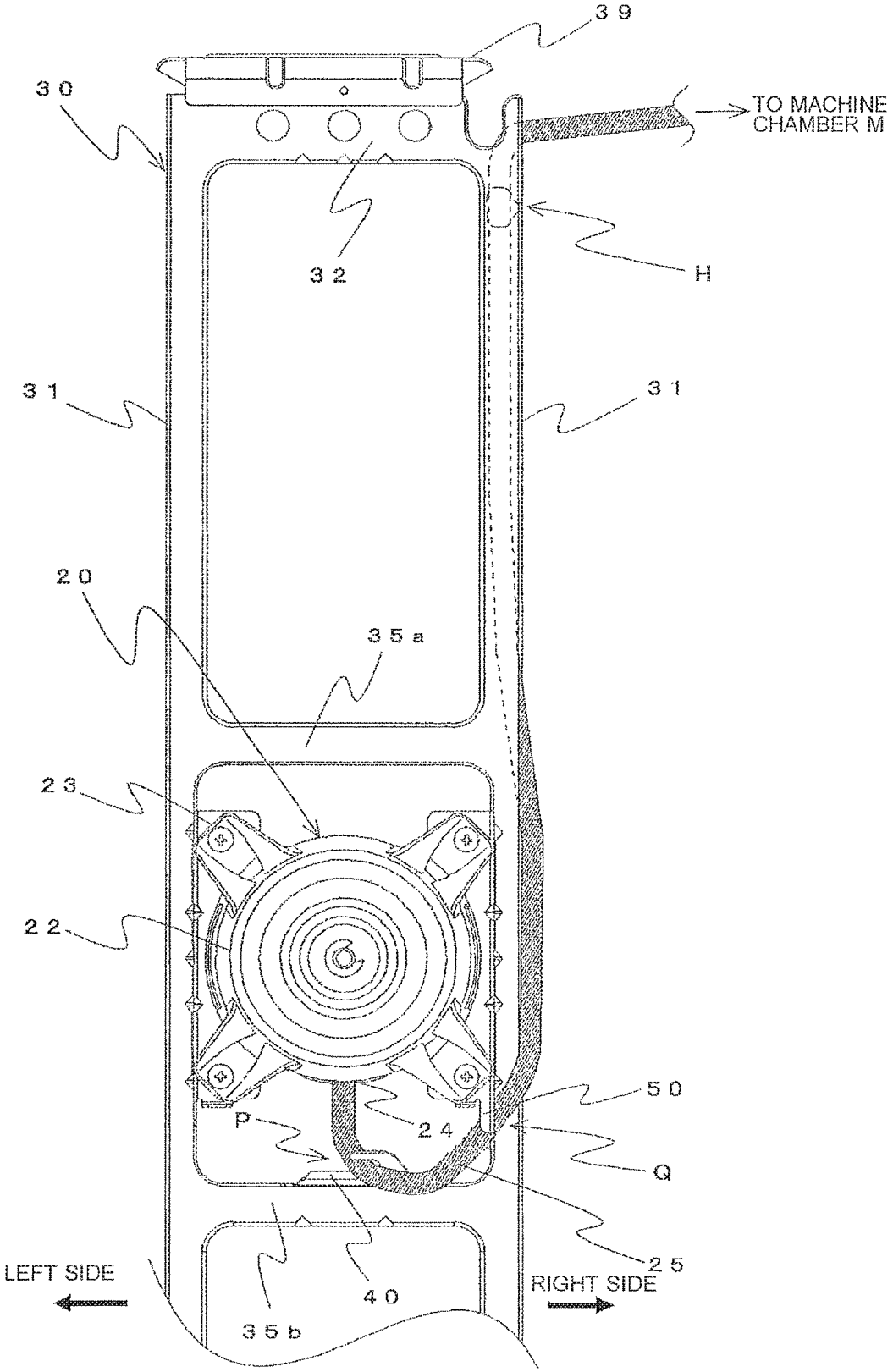
FIG. 13 is a view for illustrating a wiring path of the lead wire in the outdoor unit illustrated in FIG. 1 as viewed from the front side.

Now, with reference to FIG. 11 to FIG. 13, description is made of the handling structure for the lead wire 25 in the outdoor unit 100, that is, the configuration of leading the lead wire 25 of the fan motor 20 from the lead wire lead-out portion 24 to the electrical component unit 10 in the machine chamber M.

The fixing plates 34 are fixed by screws to the bottom plate 1, and the fan motor 20 is fixed to the motor mounting surfaces 36 of the fan motor support 30 which stands on the bottom plate 1. The fan motor 20 is fixed by four screws which are screwed through the screw passing holes 23*a* of the mounting legs 23 into the screw holes 36*a* of the motor mounting surfaces 36.

At this time, as illustrated in FIG. 6, the fan motor 20 is mounted so that the lead wire lead-out portion 24 is positioned at the lower end of the main body portion 22. The screw passing holes 23*a* of the four mounting legs 23 and the screw holes 36*a* of the motor mounting surfaces 36 may be prevented from being arranged equiangularly in the circumferential direction, and at least one of the screw passing holes 23*a* of the mounting legs 23 and the screw holes 36*a* of the motor mounting surfaces 36 may be arranged at an unequal angle in the circumferential direction. With this configuration, there may be provided a mounting angle error preventing structure. With the mounting angle error preventing structure, not all of the screw passing holes 23*a* and the screw holes 36*a* match with each other when an angle of the fan motor 20 in the circumferential direction does not allow the lead wire lead-out portion 24 to be positioned at the lower end of the main body portion 22, and the four screws are prevented from being fastened.

The lead wire lead-out portion 24, which is positioned at the lower end of the main body portion 22 and has the plurality of electric lines arranged in the rightward-and-leftward direction, has a center in the rightward-and-leftward direction that substantially matches with the center line L of the fan motor support 30. Therefore, the lead wire 25 is led out downward along the center line L.

FIG. 11 is a perspective view for illustrating a first direction-changing portion P of the lead wire 25 in the lead wire handling structure. The first direction-changing portion P of the lead wire 25 is positioned vertically downward from the main body portion 22 of the fan motor 20 by a predetermined distance. At the first direction-changing portion P, a lead-out direction of the lead wire 25 which is oriented in the direction toward the bottom plate 1 is changed to the direction toward the machine chamber M. That is, the lead wire 25 which is led out downward is bent toward the rightward direction in front view at the first direction-changing portion P.

The first direction-changing portion P is formed when the lead wire 25 is brought into the rightward-and-leftward direction guide groove 43 formed in the rightward-and-leftward direction guide piece 40 of the fan motor support 30 and is bent at the groove edge 43*a*. The lead wire 25 is hooked to the groove edge 43*a* so that the direction in which the lead wire 25 is led is changed. The rightward-and-leftward direction guide groove 43 is a U-shaped groove being opened in a direction opposite to the machine chamber M in the rightward-and-leftward direction, that is, being opened in the leftward direction. Therefore, the lead wire 25 is hooked to the groove edge 43*a* at the portion corresponding to a groove bottom of the rightward-and-leftward direction guide groove 43 and led toward the rightward direction. The rightward-and-leftward direction guide piece 40 is positioned vertically downward from the main body portion 22 of the fan motor 20 by a predetermined distance.

As illustrated in FIG. 9, in the rightward-and-leftward direction guide piece 40, the guide portion 42 having the rightward-and-leftward direction guide groove 43 is formed so as to be extended as a base from the distal end of the projection portion 41 extending in the direction toward the front side. Therefore, the rightward-and-leftward direction guide groove 43 is positioned on the front side from the lower intermediate transverse plate 35*b* at least by a projection length of the projection portion 41 toward the front side, that is, by the amount of the width of the projection portion 41 in the frontward-and-rearward direction. When an operator performs an operation of bringing the lead wire 25 into the rightward-and-leftward direction guide groove 43 and hooking the lead wire 25 to the groove edge 43*a* to bend the lead wire 25 in the direction toward the machine chamber M, the operator performs the above-mentioned operation by reaching out a hand from the front side while taking a posture of facing the front side of the fan motor support 30.

The fan motor support 30 is positioned on the rear side of the outdoor unit 100 in the frontward-and-rearward direction (depth direction). Therefore, for an operator who performs the operation from the front side, it is easier to perform operation when the rightward-and-leftward direction guide groove 43 is positioned closer to the operator. When the projection portion 41 extended toward the front side is formed on the rightward-and-leftward direction guide piece 40, the rightward-and-leftward direction guide groove 43, into which the lead wire 25 is brought, is approached closer to the operator, with the result that favorable operability of the operator is achieved.

Note that, the air-sending fan 7 being the propeller fan is thereafter mounted to the rotary shaft 21 projecting from the front of the fan motor 20. Therefore, the projection length of the projection portion 41 is limited so that the lead wire 25 routed at the first direction-changing portion P is prevented from being brought into contact with the rotating air-sending fan 7.

The guide portion 42 is bent obliquely upward at an angle of 45 degrees from the distal end of the projection portion 41 so that the projection end of the guide portion 42 is inclined so as to be positioned in front of and above the distal end of the projection portion 41. That is, the guide portion 42 is inclined toward the motor mounting surface 36 side. It can be said that, in a state after the fan motor 20 is mounted to the motor mounting surfaces 36, the guide portion 42 is inclined in the direction of approaching the fan motor 20.

As described above, the lead wire lead-out portion 24 is positioned on the rear side of the main body portion 22. Therefore, when the operator, who operates from the front side, intends to bring the lead wire 25 into the rightward-and-leftward direction guide groove 43 positioned in front of and below the lead wire lead-out portion 24, the operator first leads the lead wire 25, which extends downward from the lead wire lead-out portion 24, to the near side. At that time, a portion of the lead wire 25 from the lead wire lead-out portion 24 to a part held by the operator is brought into a state of being inclined in the frontward-and-rearward direction, in which the near side (side on which the operator is present) is lower.

The guide portion 42 is inclined so that the near side is higher. As a matter of course, the rightward-and-leftward direction guide groove 43 formed so as to be opened in the rightward-and-leftward direction, which is the leftward direction in this case, is also inclined similarly to the guide portion 42. Therefore, the lead wire 25 led by the operator to the near side and the opening of the rightward-and-leftward direction guide groove 43 are brought into a relationship of intersecting each other. Therefore, the lead wire 25 can easily be brought into the rightward-and-leftward direction guide groove 43 without requiring the operator to apply a force to bend the lead wire 25, and can smoothly be moved in the rightward-and-leftward direction guide groove 43 toward the groove bottom.

When the lead wire 25 and the opening of the rightward-and-leftward direction guide groove 43 are in a state of intersecting each other at a right angle, the lead wire 25 can most easily be brought into the rightward-and-leftward direction guide groove 43. In the outdoor unit 100, the guide portion 42 is inclined by 45 degrees in the direction toward the fan motor 20 with respect to the horizontal projection portion 41. However, the inclination angle of the guide portion 42 is a matter of design. The inclination angle of the guide portion 42 may suitably be set in accordance with a positional relationship between the lead wire lead-out portion 24 and the rightward-and-leftward direction guide piece 40, an operating position of the operator, or the like so that the lead wire 25 pulled by the operator toward the near side and the guide portion 42 of the rightward-and-leftward direction guide piece 40 intersect each other at an angle close to the right angle.

Further, in the guide portion 42 of the rightward-and-leftward direction guide piece 40, the guide portion root portion 42*a* extends in the opening direction from the opening of the rightward-and-leftward direction guide groove 43 over the center line L in the rightward-and-leftward direction, and has, at an upper end thereof, the distal end edge 42*b* which is continuous with the groove edge 43*a* of the rightward-and-leftward direction guide groove 43 without a step. Further, the distal end edge 42*b* and the groove edge 43*a* are bent in the direction toward the rear side with corner portions having a curved shape. Therefore, the operator can easily bring the lead wire 25 into the rightward-and-leftward direction guide groove 43 by only bringing the lead wire 25 led to the near side into contact with the distal end edge 42*b* and allowing the lead wire 25 to slide in the rightward-and-leftward direction, which is the rightward direction in this case, along the surface of the distal end edge 42*b* having a flange shape.

Any item which hinders pulling of the lead wire 25 toward the near side is not provided between the distal end edge 42*b* and the fan motor 20. Therefore, the operator can easily bring the lead wire 25 into contact with the distal end edge 42*b*. Further, the distal end edge 42*b* and the groove edge 43*a* are bent to have a flange shape. Therefore, the lead wire on the distal end edge 42*b* can be smoothly slid on the surfaces of the distal end edge 42*b* and the groove edge 43*a* toward the groove bottom of the rightward-and-leftward direction guide groove 43. As described above, the rightward-and-leftward direction guide piece 40 has a structure which is excellent in operability for the operation of bringing the lead wire 25 into the rightward-and-leftward direction guide groove 42.

Further, the bent distal end edge 42*b* and groove edge 43*a* have round corners, and hence the surface of the lead wire 25 is prevented from being damaged even when the lead wire 25 slides on surfaces of the bent distal end edge 42*b* and the groove edge 43*a*. Further, the distal end edge 42*b* and the groove edge 43*a* are bent in the direction toward the rear side, and hence there is no fear in that the operator standing on the front side touches distal ends of the distal end edge 42*b* and the groove edge 43*a* during the operating of bringing the lead wire 25 into the rightward-and-leftward direction guide groove 42.

The operator slides the lead wire 25 toward the groove bottom of the rightward-and-leftward direction guide groove 43, that is, in the rightward direction, hooks the lead wire 25 to the groove edge 43*a* corresponding to the groove bottom portion, and leads the lead wire 25 in the rightward direction. The lead wire 25 led in the rightward direction, that is, toward the machine chamber M side is then led in the upward direction at a second direction-changing portion Q.

FIG. 12 is a perspective view for illustrating the second direction-changing portion Q of the lead wire 25 in the lead wire handling structure. The second direction-changing portion Q of the lead wire 25 is positioned above the rightward-and-leftward direction guide piece 40 constructing the first direction-changing portion P. The second direction-changing portion Q is formed by bringing the lead wire 25 into the upward direction guide groove 51 formed in the upward direction guide piece 50 of the fan motor support 30, and by bending the lead wire 25 at the groove edge 51*a* of the upward direction guide groove 51. The lead wire 25 is hooked to the groove edge 51*a* to change the orientation of the wiring path of the lead wire 25. It should be noted that, in this case, the wiring path of the lead wire 25 corresponds to a path of the lead wire 25 from the lead wire lead-out portion 24 to the electrical component unit 10.

The upward direction guide groove 51 is a U-shaped groove being opened in the downward direction. Therefore, the lead wire 25 is hooked to the upper groove edge 51*a* corresponding to the groove bottom of the upward direction guide groove 51 and is led in the upward direction. The lead wire 25 extending downward is guided at first direction-changing portion P in the direction toward the machine chamber M in the rightward-and-leftward direction, in this case in the rightward direction, and the lead wire 25 extending in the rightward direction is then guided at the second direction-changing portion Q in the upward direction.

As illustrated in FIG. 10, the upward direction guide piece 50 having the upward direction guide groove 51 is formed by bending the support column 31 on the machine chamber M side from the inner side toward the front side. Therefore, the upward direction guide groove 51 is formed on the front side with respect to the support column 31. When the upward direction guide groove 51 is positioned closer to the operator, it is easier for the operator who operates from the front side to bring the lead wire 25 into the upward direction guide groove 51. When the upward direction guide piece 50 is provided so as to project toward the front side, the upward direction guide groove 51 is approached closer to the operator, thereby being capable of improving the operability for the operator.

In this case, the upward direction guide piece 50 is formed so as to be continuous from the standing wall 37. Therefore, the upward direction guide groove 51 is positioned between the motor mounting surfaces 36 and the pair of support columns 31 in the frontward-and-rearward direction. However, the upward direction guide piece 50 may be formed independently from the standing wall 37, and the upward direction guide groove 51 may be positioned on the front side with respect to the motor mounting surface 36 to be approached closer to the operator. However, a position of the upward direction guide groove 51 is restricted so that the lead wire 25, which is routed at the second direction-changing portion Q, is prevented from being brought into contact with the rotating air-sending fan 7.

Further, in the upward direction guide piece 50, the root portion 50*a* has a front end edge 50*b* which extends in the opening direction from the opening of the upward direction guide groove 51, that is, in the downward direction. Further, both the front end edge 50*b* and the groove edge 51*a* have corner portions having a curved shape and are bent into a flange shape toward the fan motor 20 side. Therefore, an operator can easily bring the lead wire 25 into the upward direction guide groove 51 merely by bringing the lead wire 25 into contact with the front end edge 50*b* and sliding the lead wire 25 on the surface of the front end edge 50*b* in the upward direction, and can slide the lead wire 25 on the surface of the groove edge 51*a* being continuous with the front end edge 50*b* toward the groove bottom formed at an upper portion of the upward direction guide groove 51.

The front end edge 50*b* and the groove edge 51*a* having the flange shape are formed into the round shape at corner portions thereof. Therefore, even when the lead wire 25 slides on surfaces of the front end edge 50*b* and the groove edge 51*a*, the surface of the lead wire 25 is prevented from being damaged. As described above, the upward direction guide piece 50 is excellent in operability for the operation of bringing the lead wire 25 into the upward direction guide groove 51.

The lead wire 25 which is led from the rightward direction to the upward direction through the second direction-changing portion Q extends upward along the support column 31 on the machine chamber M side and is retained at a retaining portion H which is positioned at an upper portion of the support column 31. The retaining portion H is configured to sandwich the lead wire 25 with the rear surface of the support column 31 and the lead wire holding piece 13, which is formed at an upper portion on the outer side of the support column 31 to project toward the rear side, and is bent toward the inner side (see FIG. 14). The lead wire 25 is routed from the outer side to the rear side of the support column 31 after passing through the second direction-changing portion Q, and is led upward in the support column back groove 31*a* above the upper intermediate transverse plate 35*a* to reach the retaining portion H.

Figure 14:
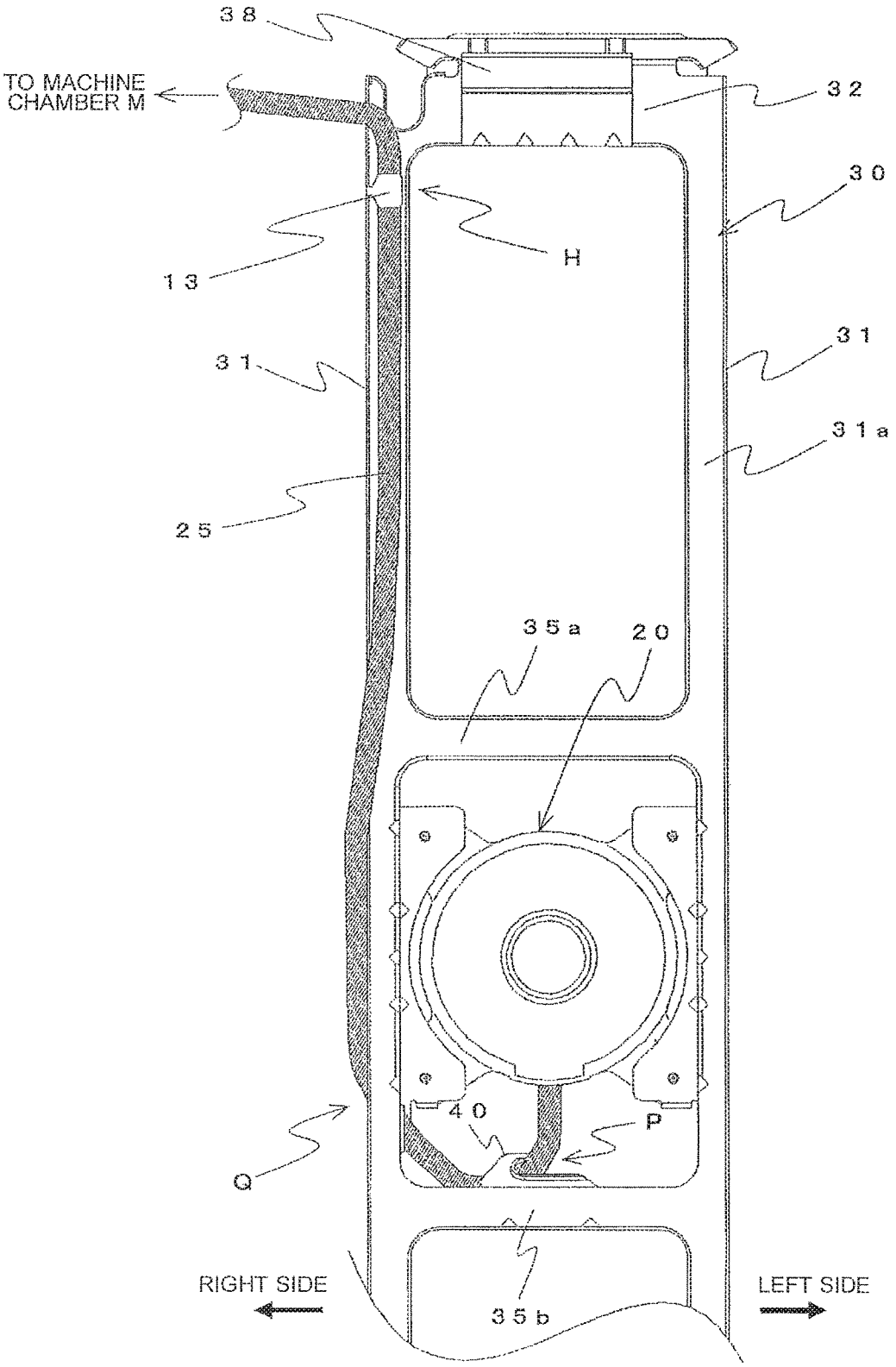
FIG. 14 is a view of the wiring path of the lead wire in the outdoor unit illustrated in FIG. 1 as viewed from the rear side.

FIG. 13 and FIG. 14 are views for illustrating the wiring path of the lead wire 25 along the fan motor support 30, as viewed from the front side in FIG. 13 and from the rear side in FIG. 14. The lead wire 25 which is once fixed to the fan motor support 30 at the retaining portion H is led toward the machine chamber M from the retaining portion H through an upper portion of the fan chamber F on the rear side, and enters the machine chamber M through a cutout (not shown) formed in the upper portion of the partition plate 6. The lead wire 25 having entered the machine chamber M is fixed to a surface of the partition plate 6 on the machine chamber M side with use of a retainer and connected to a connector (not shown) on the electric board received in the electrical component unit 10.

Even when the lead wire 25 is led from the lead wire lead-out portion 24 to the retaining portion H without being loosened, and is retained at the retaining portion H under a state in which the lead wire 25 is tensioned in respective directions from the lead wire lead-out portion 24 to the first direction-changing portion P, from the first direction-changing portion P to the second direction-changing portion Q, and from the second direction-changing portion Q to the retaining portion H, the rightward-and-leftward direction guide groove 43 constructing the first direction-changing portion P is spaced apart from the fan motor 20 and is formed at a position vertically below the main body portion 22 of the fan motor, and the lead wire 25 is bent at the groove edge 43*a* of the rightward-and-leftward direction guide groove 43 and is changed in orientation of the wiring path. Therefore, as illustrated in FIG. 13 and FIG. 14, the lead wire 25 extending from the lead wire lead-out portion 24 to the first direction-changing portion P is substantially prevented from being inclined in the rightward-and-leftward direction.

Therefore, even when the lead wire 25 at this portion is in a state of being tensioned, most of the force applied to the lead wire lead-out portion 24, that is, to the root portion of the lead wire 25 is a downward pulling force, and substantially no shear force in the rightward-and-leftward direction is applied. Therefore, occurrence of the breakage of the lead wire 25 at the lead wire lead-out portion 24 due to the shear force can be prevented. With the lead wire handling structure having such a rightward-and-leftward direction guide groove 43, the outdoor unit 100 can be a highly reliable outdoor unit which prevents breakage of the root portion of the lead wire 25 caused by handling of the lead wire 25.

Further, with the upward direction guide groove 51 constructing the second direction-changing portion Q, the lead wire 25 having the wiring path changed from the upward-and-downward direction to the direction toward the machine chamber M at the first direction-changing portion P can be changed to the upward direction. Therefore, the lead wire 25 can be led along the support column 31 to the retaining portion H at the upper portion thereof, thereby being capable of preventing a portion of the lead wire 25 on the wiring path from being brought into contact with the air-sending fan 7.

The upward direction guide piece 50 is provided at a position above the rightward-and-leftward direction guide piece 40. This is because the presence of the retaining portion H at the upper portion of the fan motor support 30 enables shortening of the length of the lead wire 25 as compared to the case in which the upward direction guide piece 50 is provided at a position below the rightward-and-leftward direction guide piece 40. The retaining portion H is provided at the upper portion of the support column 31 because the electrical component unit 10 to which the lead wire 25 is connected is positioned in an upper portion of the machine chamber M, and a measure is taken to shorten the wiring path of the lead wire 25 avoiding the contact with the air-sending fan 7.

Further, both the groove edge 43*a* of the rightward-and-leftward direction guide groove 43 and the groove edge 51*a* of the upward direction guide groove 51, which are configured to receive the lead wire 25 hooked thereto and change the orientation of the wiring path, are bent into a flange shape, and corner portions thereof are formed into an arcuate shape. Therefore, even when the lead wire 25 is routed and brought into a tensioned state, the surface of the lead wire 25 is prevented from being damaged. Further, a contact area with the lead wire 25 is large, and hence the stress locally applied to the contact portion can be reduced. Accordingly, there is no fear in that the lead wire 25 is broken at the groove edges 43*a* and 51*a*.

In the rightward-and-leftward direction guide piece 40, there is formed the distal end edge 42*b*, which extends beyond the opening of the rightward-and-leftward direction guide groove 43 in the opening direction, and is continuous with the groove edge 43*a* without a step. In the upward direction guide piece 50, there is formed the front end edge 50*b*, which extends in the downward direction beyond the upward direction guide groove 51 and is continuous with the groove edge 51*a* without a step. Similarly to the groove edges 43*a* and 51*a*, the distal end edge 42*b* and the front end edge 50*b* have corner portions having an arcuate shape and are bent into the flange shape. Therefore, the operator can easily and quickly bring the lead wire 25 into the rightward-and-leftward direction guide groove 43 or the upward direction guide groove 51 only by bringing the lead wire 25 into contact with the distal end edge 42*b* or the front end edge 50*b* and sliding the lead wire 25 on the surface of the distal end edge 42*b* or the surface of the front end edge 50*b*. Thus, excellent operability is achieved. Further, even when the lead wire 25 is slid, the surface of the lead wire 25 is prevented from being damaged. Thus, excellent reliability is achieved.

In the rightward-and-leftward direction guide piece 40 of the first direction-changing portion P, there is formed the projection portion 41 which projects in the front direction being the direction toward the position at which the operator performs the wiring operation for the lead wire 25, and the upward direction guide piece 50 of the second direction-changing portion Q is formed by being bent from the inner side of the support column 31 in the front direction. Therefore, both the rightward-and-leftward direction guide groove 43 and the upward direction guide groove 51 are positioned on the front side approaching to the operator than the pair of support columns 31. Thus, the operator can easily perform the operation of bringing the lead wire 25 into the guide grooves 43 and 51.

Further, in the rightward-and-leftward direction guide piece 40, the guide portion 42 having the rightward-and-leftward direction guide groove 43 has a distal end (projection end) which is positioned on the front side of the outdoor unit 100 with respect to the intermediate transverse plates 35*a* and 35*b* and is inclined with respect to the horizontal direction in the direction of approaching the fan motor 20 mounted to the motor mounting surfaces 36. Therefore, the lead wire 25 pulled by the operator to the near side and the rightward-and-leftward direction guide groove 43 intersect each other, and hence the operator can easily and quickly bring the lead wire 25 into the rightward-and-leftward direction guide groove 43. Thus, excellent operability is achieved.

Further, in the rightward-and-leftward direction guide piece 40, the rightward-and-leftward direction guide groove 43 and the opening thereof are positioned on the machine chamber M side with respect to the center line L of the fan motor support 30.

Therefore, the lead wire 25 which extends from the lead wire lead-out portion 24 positioned on the center line L in the fan motor 20 mounted to the motor mounting surfaces 36 can be smoothly brought by the operator into the rightward-and-leftward direction guide groove 43 without shifting the lead wire 25 in advance in the rightward-and-leftward direction. Thus, excellent operability is achieved.

It should be noted that the upward direction guide groove 51 of the second direction-changing portion Q is not an essential element of the present invention. As in the case of the retaining portion H positioned at the upper portion of the support column 31, even when at a position which is equal to or higher than a height of the rightward-and-leftward direction guide groove 43 of the support column 31 on the machine chamber M side, the lead wire 25 is retained by a bent pressing piece at the support column 31 on the machine chamber M side or at the vicinity thereof, and then the wiring path of the lead wire 25 is changed in orientation in the upward direction, the lead wire 25 can be led along the support column 31 to the retaining portion H at the upper portion of the support column 31. Another configuration which is not a configuration of hooking onto the upward direction guide groove 51, for example, the retaining configuration as described above may be employed to construct the second direction-changing portion Q.

In such a case, even when the lead wire 25 is led from the lead wire lead-out portion 24 to the first direction-changing portion P and retains at the retaining position in a tensioned state, with the configuration of the rightward-and-leftward direction guide piece 40 of the first direction-changing portion P described above, there can be obtained the lead wire handling structure which is excellent in reliability of preventing breakage at the root portion of the lead wire 25 due to the handling of the lead wire 25.

Embodiment 2

According to the description above, under the state in which the fan motor 20 is mounted to the motor mounting surfaces 36 of the fan motor support 30, the lead wire lead-out portion 24 is positioned at the lower end of the main body portion 22 of the fan motor, and the rightward-and-leftward direction guide piece 40 projects from the upper end of the lower intermediate transverse plate 35*b*, with the result that the first direction-changing portion P is provided below the fan motor 20. However, according to Embodiment 2 of the present invention, the fan motor 20 may be mounted to the fan motor mounting surfaces 36 so that the lead wire lead-out portion 24 is positioned at an upper end of the main body portion 22 of the fan motor, and the rightward-and-leftward direction guide piece 40 may project from a lower end of the upper intermediate transverse plate 35*a*, with the result that the first direction-changing portion P can be provided above the fan motor 20. With such a configuration, the same effect as that of Embodiment 1 can be obtained.

In Embodiment 2, the rightward-and-leftward direction guide piece 40 is provided at a position apart from the fan motor 20 and vertically above the main body portion 22 of the fan motor so as to project from the lower end of the upper intermediate transverse plate 35*a*. In this case, the projection portion 41 is bent by a predetermined dimension toward the front side as in Embodiment 1, and the guide portion 42 is bent obliquely downward so as to be continuous with the distal end of the projection portion 41. The guide portion 42 is inclined toward the fan motor mounting surface 36 side. Therefore, in Embodiment 1, the guide portion 42 is inclined so that the distal end of the guide portion 42 is provided above the up-and-down position of the projection portion 41. However, in Embodiment 2, the guide portion 42 is inclined in such an orientation that the distal end of the guide portion 42 is provided below the up-and-down position of the projection portion 41. Other configurations of the rightward-and-leftward direction guide piece 40 are the same as those of Embodiment 1.

Also in Embodiment 2, in order to shorten the wiring path of the lead wire 25, it is desired that the second direction-changing portion Q be provided at a position above the right-and-left direction guide piece 40 in the support column 31 on the machine chamber M side. For example, the support column 31 on the machine chamber M side is bent from the inner side to the front side thereof at a position above the upper intermediate transverse plate 35*a* to form the upward direction guide piece 50 having the upward direction guide groove 51, to thereby construct the second direction-changing portion Q.

As described above, when the orientation of the fan motor 20 fixed to the motor mounting surfaces 36 is set so that the lead wire lead-out portion 24 is positioned at the lower portion of the main body portion 22 of the fan motor, the rightward-and-leftward direction guide piece 40 having the rightward-and-leftward direction guide groove 43 is formed in the lower intermediate transverse plate 35*b*. When the orientation of the fan motor 20 fixed to the motor mounting surfaces 36 is set so that the lead wire lead-out portion 24 is positioned at the upper portion of the main body portion 22 of the fan motor, the rightward-and-leftward direction guide piece 40 is formed in the upper intermediate transverse plate 35*a*. The former case corresponds to Embodiment 1, and the latter case corresponds to Embodiment 2. In any of those cases, the rightward-and-leftward direction guide piece 40 is formed so as to project from the end surface of the intermediate transverse plates 35*a* or 35*b* on the motor mounting surface 36 side (lower end in the case of the upper intermediate transverse plate 35*a*, and upper end in the case of the lower intermediate transverse plate 35*b*), and the guide portion 42 having the rightward-and-leftward direction guide groove 43 is inclined with respect to the projecting direction of the projection portion 41 in a direction of approaching the fan motor 20 mounted to the motor mounting surfaces 36.

When the object of improving the operability of the handling operation (routing operation) for the lead wire 25 is t disregarded, but emphasis is placed on achieving the object of preventing breakage of the lead wire 25 due to the shear force in the rightward-and-leftward direction which acts on the root portion of the lead wire 25 in the lead wire handling structure, that is, preventing partial breakage of individual unbundled electric lines in the lead wire lead-out portion 24, the projection portion 41 may be omitted from the rightward-and-leftward direction guide piece 40, and the guide portion 42 may project from the upper end of the lower intermediate transverse plate 35*b* or from the lower end of the upper intermediate transverse plate 35*a* to incline with respect to the horizontal direction in a direction of approaching the fan motor 20 mounted to the motor mounting surfaces 36.

Further, when the object of improving the operability of the handling operation for the lead wire 25 is similarly disregarded, but the emphasis is placed on achieving the object of preventing the breakage at the root portion of the lead wire 25, in any of the case of providing the projection portion 41 and the case of not providing the projection portion 41, the guide portion 42 may be formed so as to project in parallel to the extending direction of the pair of support columns 31 without being inclined with respect to the horizontal direction in the direction of approaching the fan motor 20. In this case, the rightward-and-leftward direction guide groove 43 and the groove width direction are parallel to the extending direction of the pair of support columns 31, and the groove edge 43*a* of the rightward-and-leftward direction guide groove 43 and the distal end edge 42*b* of the guide portion root portion 42*a* project toward the rear side in a flange shape.

When the projection portion 41 is provided, the guide portion 42 is bent upward (corresponding to Embodiment 1) or downward (corresponding to Embodiment 2) at a right angle from the distal end of the projection portion 41 bent toward the front side. When the projection portion 41 is not provided, the guide portion 42 projects directly upward from the upper end of the lower intermediate transverse plate 35*b* (corresponding to Embodiment 1) or directly downward from the lower end of the upper intermediate transverse plate 35*a* (corresponding to Embodiment 2) so that a front surface thereof projects in flush with the front surface of the lower intermediate transverse plate 35*b* or the upper intermediate transverse plate 35*a*. In any of those cases, the breakage of the lead wire 25 due to the shear force in the rightward-and-leftward direction which is applied to the root portion of the lead wire 25 in the lead wire handling structure can be prevented.

It is not always necessary that both the upper intermediate transverse plate 35*a* and the lower intermediate transverse plate 35*b* be provided. Only one intermediate transverse plate on a side on which the rightward-and-leftward direction guide piece 40 projects may be provided. The rightward-and-leftward direction guide piece 40 is formed so as to project in the direction of approaching the motor mounting surface 36 from the end surface on the motor mounting surface 36 side of any one of the intermediate transverse plates 35*a* and 35*b* formed on the middle part of the pair of support columns 31 and across the pair of support columns 31 in the rightward-and-leftward direction.

REFERENCE SIGNS LIST

5 top panel 6 partition plate 7 air-sending fan 8 heat exchanger 9 compressor 10 electrical component unit 15 casing 20 fan motor 25 lead wire 30 fan motor support 31 pair of support columns 35*a* upper intermediate transverse plate 35*b* lower intermediate transverse plate 36 motor mounting surfaces 37 standing wall 40 rightward-and-leftward direction guide piece

41 projection portion 42 guide portion 42*a* guide portion root portion 42*b* distal end edge 43 rightward-and-leftward direction guide groove 43*a* groove edge 50 upward direction guide piece 51 upward direction guide groove 100 outdoor unit F fan chamber L center line M machine chamber

The invention claimed is:

1. An outdoor unit for an air-conditioning apparatus, comprising:

a partition plate for partitioning an inside of a casing in a rightward-and-leftward direction to form a fan chamber in which a heat exchanger and an air-sending fan are installed, and a machine chamber in which a compressor is arranged;

an electrical component unit arranged in an upper portion of the machine chamber;

a fan motor configured to drive the air-sending fan to rotate and including a lead wire which is led to the electrical component unit; and a fan motor support positioned between the heat exchanger and the air-sending fan and configured to fix the fan motor, wherein the fan motor support includes a pair of support columns arranged apart from each other in the rightward-and-leftward direction and extend in an upward-and-downward direction, motor mounting surfaces, wherein each motor mounting surface is formed in a middle of the pair of support columns in the upward-and-downward direction, and each motor mounting surface is configured to mount the fan motor, an intermediate transverse plate provided above or below the motor mounting surfaces in the middle of the pair of support columns in the upward-and-downward direction and extending across the pair of support columns in the rightward-and-leftward direction, and a rightward-and-leftward direction guide piece formed to project in a direction toward the fan motor from a motor-facing surface of the intermediate transverse plate and from a position above or below the fan motor in a vertical direction and spaced apart from the fan motor in a state in which the fan motor is mounted to the motor mounting surfaces, wherein the rightward-and-leftward direction guide piece includes a rightward-and-leftward direction guide groove formed to be opened in a direction opposite to the machine chamber in the rightward-and-leftward direction and recessed in a direction toward the machine chamber, and the rightward-and-leftward direction guide groove is configured to change a wiring path of the lead wire hooked thereto to a direction toward the machine chamber from the upward-and-downward direction, and a guide portion having the rightward-and-leftward direction guide groove and a projection end of the rightward-and-leftward direction guide piece, wherein, in the guide portion, the projection end is positioned closer to a front side of the outdoor unit than the intermediate transverse plates, and the projection end is inclined with respect to a horizontal direction in the direction toward the fan motor.

2. The outdoor unit for an air-conditioning apparatus of claim 1, wherein the rightward-and-leftward direction guide groove and an opening thereof are positioned on a side of a center line L of the fan motor support that is closer to the machine chamber in the rightward-and-leftward direction.

3. The outdoor unit for an air-conditioning apparatus of claim 2, wherein the guide portion comprises a guide portion root portion having a distal end edge positioned on the intermediate transverse plate side of the guide portion over the center line L and is continuous with a groove edge of the rightward-and-leftward direction guide groove, and wherein the distal end edge and the groove edge of the rightward-and-leftward direction guide groove form a J-shape.

4. The outdoor unit for an air-conditioning apparatus of claim 3, wherein the distal end edge and the groove edge of the rightward-and-leftward direction guide groove are bent in a direction toward the rear side of the outdoor unit with corner portions having a curved shape.

5. The outdoor unit for an air-conditioning apparatus of claim 1, wherein the rightward-and-leftward direction guide piece comprises a projection portion bent from the motor-facing surface of the intermediate transverse plate and projects toward the front side of the outdoor unit, and wherein the guide portion is continuous with a distal end of the projection portion.

6. The outdoor unit for an air-conditioning apparatus of claim 1, wherein the fan motor support further comprises:

an upward direction guide piece, which is continuous with a support column of the pair of support columns that is closer to the machine chamber and projects toward the front side of the outdoor unit; and an upward direction guide groove formed in the upward direction guide piece to be opened downward and recessed in the upward direction and configured to hook the lead wire thereto to change a wiring path of the lead wire toward the machine chamber at the rightward-and-leftward direction guide groove to the upward direction.

7. The outdoor unit for an air-conditioning apparatus of claim 6, wherein the upward direction guide groove is formed above the rightward-and-leftward direction guide groove.

8. The outdoor unit for an air-conditioning apparatus of claim 7, wherein the motor mounting surfaces are positioned closer to the front side of the outdoor unit than the pair of support columns, wherein the fan motor support comprises standing walls connecting the support columns and the motor mounting surfaces to each other, and wherein the upward direction guide piece is formed to be continuous with a lower end of the standing walls.

* * * * *